US008651034B2

(12) United States Patent
Taguchi

(10) Patent No.: US 8,651,034 B2
(45) Date of Patent: Feb. 18, 2014

(54) EMBROIDERY FRAME AND SEWING MACHINE

(75) Inventor: Shoichi Taguchi, Toyohashi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 744 days.

(21) Appl. No.: 12/857,128

(22) Filed: Aug. 16, 2010

(65) Prior Publication Data

US 2011/0056419 A1 Mar. 10, 2011

(30) Foreign Application Priority Data

Sep. 8, 2009 (JP) ..... 2009-207149

(51) Int. Cl.
*D05C 7/04* (2006.01)

(52) U.S. Cl.
USPC ..... 112/103

(58) Field of Classification Search
USPC ..... 112/102, 103, 104, 102.5, 118, 119, 112/475.04, 475.18, 475.19
See application file for complete search history.

(56) References Cited

U.S. PATENT DOCUMENTS

| | | | | |
|---|---|---|---|---|
| 4,388,883 | A * | 6/1983 | Hirota et al. | 112/102.5 |
| 6,161,491 | A * | 12/2000 | Takenoya et al. | 112/102.5 |
| 7,212,879 | B2 | 5/2007 | Hagino | |
| 2008/0223275 | A1 | 9/2008 | Kishi et al. | |

FOREIGN PATENT DOCUMENTS

| | | |
|---|---|---|
| JP | A-3-146758 | 6/1991 |
| JP | A-2005-102915 | 4/2005 |
| JP | A-2006-087576 | 4/2006 |
| JP | A-2008-220619 | 9/2008 |

* cited by examiner

*Primary Examiner* — Tejash Patel
(74) *Attorney, Agent, or Firm* — Oliff PLC

(57) ABSTRACT

An embroidery frame includes an attachment portion that can be removably attached to an embroidery frame moving device of a sewing machine that is capable of performing embroidery sewing, a frame-side connector that is adapted to be connected to a sewing machine-side connector of the sewing machine by an attaching of the attachment portion to the embroidery frame moving device, to enable wired communication between the embroidery frame and the sewing machine, and a storage device that can be accessed from the sewing machine in a case where the frame-side connector is connected to the sewing machine-side connector.

17 Claims, 16 Drawing Sheets

EMBROIDERY FRAME AND SEWING MACHINE

CROSS-REFERENCE TO RELATED APPLICATION

This application claims priority to Japanese Patent Application No. 2009-207149, filed Sep. 8, 2009, the disclosure of which is hereby incorporated by reference in its entirety.

BACKGROUND

The present disclosure relates to an embroidery frame and a sewing machine. More specifically, the present disclosure relates to an embroidery frame that can be attached to an embroidery frame moving device of a sewing machine that is capable of performing embroidery sewing and also relates to a sewing machine that is provided with the embroidery frame moving device to which the embroidery frame can be attached.

A sewing machine is known that is capable of performing embroidery sewing of a pattern in a work cloth that is a sewn object, the pattern including a character, a symbol, a graphic design, and the like. The sewing machine is provided with an embroidery frame moving device that moves an embroidery frame that holds the work cloth. Various types of embroidery frames are provided that differ according to the pattern that will be sewn. Each of the different types of the embroidery frames can be attached to the embroidery frame moving device. A sewing machine has been proposed that, through a receiving unit (an antenna), reads information that pertains to the embroidery frame from a wireless tag that is provided in the embroidery frame. The sewing machine may, for example, determine whether a selected embroidery pattern can fit within the embroidery frame, based on the information that has been read about the embroidery frame.

SUMMARY

The sewing machine that is described above performs wireless communication with the wireless tag that is provided in the embroidery frame, acquiring and using the information that pertains to the embroidery frame. However, because the storage capacity of the wireless tag is limited, the amount of information that the sewing machine can use is also limited. Furthermore, in a case where, for example, a wireless tag other than the wireless tag in the embroidery frame that is attached to the sewing machine is present within the communication range of the receiving unit, cross talk may occur, such that the information cannot reliably be acquired from the wireless tag in the embroidery frame.

Various exemplary embodiments of the general principles herein provide an embroidery frame that is capable of storing a large amount of information and capable of communicating reliably with a sewing machine, as well as a sewing machine that can reliably acquire the information that is stored in the embroidery frame.

Exemplary embodiments herein provide an embroidery frame that includes an attachment portion, a frame-side connector, and a storage device. The attachment portion can be removably attached to an embroidery frame moving device of a sewing machine that is capable of performing embroidery sewing. The frame-side connector is adapted to be connected to a sewing machine-side connector of the sewing machine to enable wired communication between the embroidery frame and the sewing machine, by an attaching of the attachment portion to the embroidery frame moving device. The storage device can be accessed from the sewing machine in a case where the frame-side connector is connected to the sewing machine-side connector.

Exemplary embodiments also provide a sewing machine that is capable of embroidery sewing that includes a sewing device, an embroidery frame moving device, a frame support portion, a sewing machine-side connector, an information acquisition portion, and a sewing control portion. The sewing device is adapted to perform embroidery sewing on a work cloth that is provided for the embroidery sewing. The embroidery frame moving device is adapted to move an embroidery frame that holds the work cloth. The frame support portion is provided in the embroidery frame moving device and is adapted to support the embroidery frame by being engaged with an attachment portion of the embroidery frame. The sewing machine-side connector is adapted to be connected to a frame-side connector of the embroidery frame to enable wired communication between the embroidery frame and the sewing machine, by an engaging of the attachment portion of the embroidery frame with the frame support portion. The information acquisition portion, in a case where the sewing machine-side connector is connected to the frame-side connector, accesses a storage device of the embroidery frame and acquires information that is stored in the storage device, the information including sewing data, which is data that specify a color and needle drop points for an embroidery pattern to be sewn. The sewing control portion controls the sewing device based on the sewing data that are acquired by the information acquisition portion.

Exemplary embodiments further provide a computer-readable medium storing a control program for a sewing machine that includes a sewing device that is adapted to perform embroidery sewing on a work cloth for embroidery sewing and an embroidery frame moving device that is adapted to move an embroidery frame for holding the work cloth. The program includes instructions that cause a controller of the sewing machine to perform the steps of acquiring, by accessing a storage device of the embroidery frame, in a case where a sewing machine-side connector of the sewing machine is connected to a frame-side connector of the embroidery frame, information that is stored in the storage device, and controlling the sewing device based on the acquired sewing data. The sewing machine-side connector is adapted to be connected to the frame-side connector to enable wired communication between the sewing machine and the embroidery frame, by an engaging of a frame support portion of the sewing machine with an attachment portion of the embroidery frame. The frame support portion is provided in the embroidery frame moving device and is adapted to support the embroidery frame by being engaged with the attachment portion. The information that is stored in the storage device includes sewing data that specify a color and needle drop points for an embroidery pattern to sewn.

BRIEF DESCRIPTION OF THE DRAWINGS

Exemplary embodiments will be described below in detail with reference to the accompanying drawings in which.

DETAILED DESCRIPTION

Figure 1:
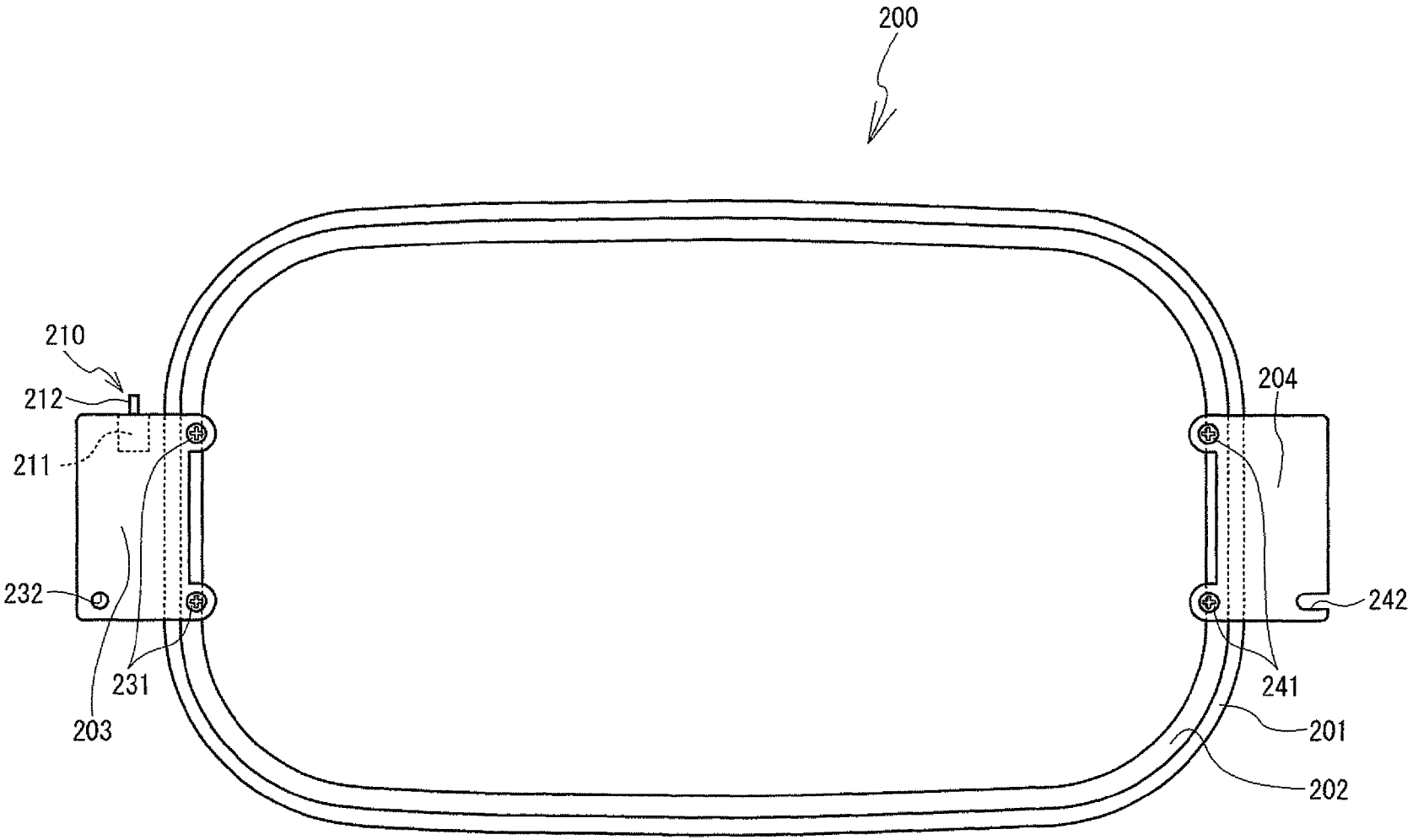
FIG. 1 is a plan view of an embroidery frame.

Hereinafter, an embodiment of an embroidery frame and a sewing machine according to the present disclosure will be explained with reference to the drawings. Note that the drawings are used to explain technological features that can be used in the present disclosure, and device configurations, flowcharts of various types of processing, and the like that are shown in the drawings are merely explanatory examples.

First, an embroidery frame 200 according to the present embodiment will be explained with reference to FIGS. 1, 2, 6, and 7. The upper side, the lower side, the right side, and the left side of FIG. 1 correspond respectively to the right side, the left side, the front side, and the rear side of the embroidery frame 200. The configuration of the embroidery frame 200 will be explained. The embroidery frame 200 is a frame that can be attached to a sewing machine that is capable of performing embroidery sewing, such as a multi-needle sewing machine 1 (refer to FIG. 3) that will be described later or the like, and then the embroidery frame 200 can be used in the sewing of an embroidery pattern. As shown in FIG. 1, the embroidery frame 200 includes an outer frame 201, an inner frame 202, a pair of left and right connecting portions 203 and 204, and a frame storage device 210.

The outer frame 201 and the inner frame 202 are members that hold a work cloth (not shown in FIG. 1) on which embroidery sewing will be performed. The outer frame 201 and the inner frame 202 are rectangular members whose long sides run in the left-right direction and whose corners are rounded. The shape of the inner circumference of the outer frame 201 is roughly identical to that of the outer circumference of the inner frame 202. The inner frame 202 can be fitted removably inside the outer frame 201. The work cloth is pinched between the outer frame 201 and the inner frame 202 and held in a taut state.

The left and right connecting portions 203 and 204 are members that can be attached and supported by a holder 24 (refer to FIG. 5) of the multi-needle sewing machine 1. The left and right connecting portions 203 and 204 are both rectangular plate-shaped members whose long sides run in the front-rear direction. The left connecting portion 203, at two locations on its right edge, is secured by two screws 231 to the left portion of the inner frame 202. The right connecting portion 204, at two locations on its left edge, is secured by two screws 241 to the right portion of the inner frame 202. An engaging hole 232 is provided close to the left front edge of the left connecting portion 203. An engaging slot 242 is provided close to the right front edge of the right connecting portion 204. The engaging hole 232 and the engaging slot 242 can be used for securing the connecting portions 203 and 204 in appropriate positions on the holder 24, which will be described later.

In the present embodiment, the frame storage device 210, which is a storage device, stores information that pertains to the embroidery pattern that is the object of embroidery sewing. The frame storage device 210 includes a box-shaped housing 211 and a connector 212 that protrudes from the housing 211. The housing 211 is secured to the bottom face of a central portion of the rear edge of the plate-shaped left connecting portion 203 (refer to FIG. 6). The connector 212 protrudes toward the rear from the rear edge of the left connecting portion 203. The frame storage device 210 can be connected to another device through the connector 212.

Figure 7:
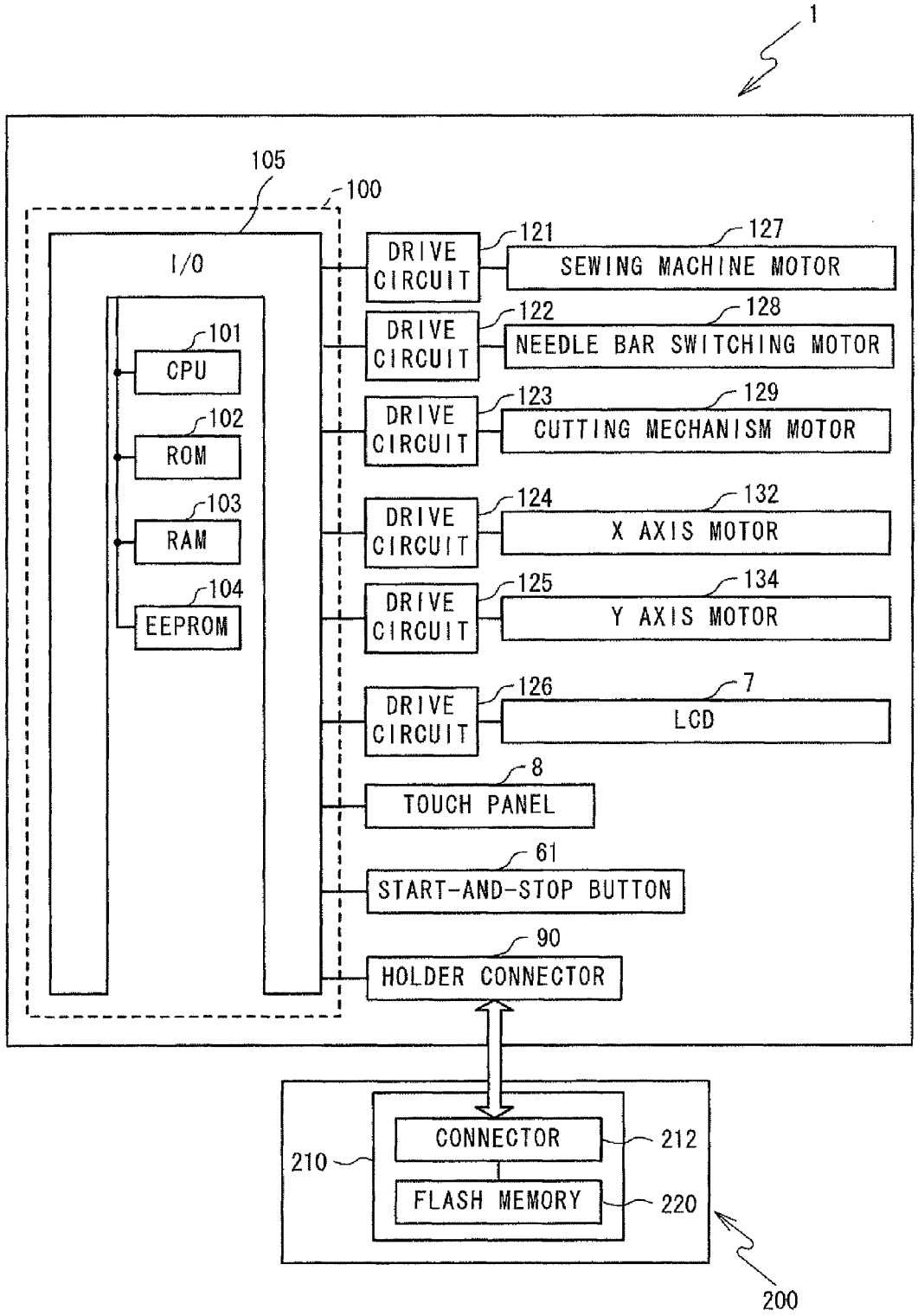
FIG. 7 is a block diagram that shows an electrical configuration of the multi-needle sewing machine.

As shown in FIG. 7, the frame storage device 210 includes a flash memory 220 (hereinafter called the frame memory 220). The flash memory 220 can be accessed from an external device that is connected to the frame storage device 210 through the connector 212. The frame storage device 210 can be configured as a Universal Serial Bus (USB) device, for example. In that case, if the frame storage device 210 is connected through the connector 212, which is a USB connector, to another device that has a USB host function, the frame storage device 210 can be recognized as a removable disk.

Figure 2:
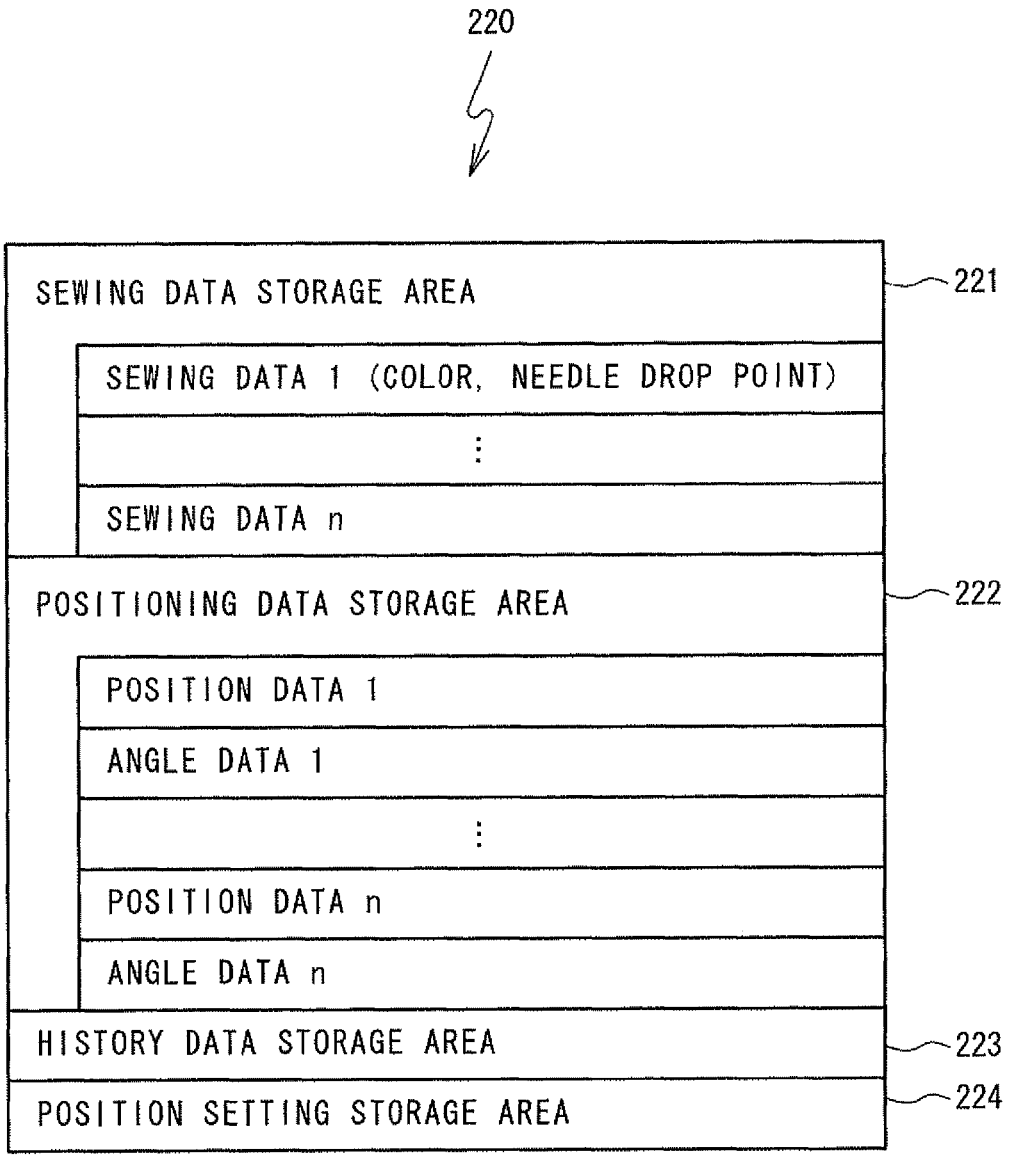
FIG. 2 is an explanatory figure of storage areas in a flash memory and of information that is stored in the storage areas.

Storage areas that are included in the frame memory 220 and information that is stored in the frame memory 220 will be explained with reference to FIG. 2. As shown in FIG. 2, the frame memory 220 has a plurality of the storage areas, including a sewing data storage area 221, a positioning data storage area 222, a history data storage area 223, and a position setting storage area 224. Storage areas that are not shown in FIG. 2 may also be included.

Sewing data are stored in the sewing data storage area 221. The sewing data are information that is required of the sewing machine for performing embroidery sewing. The sewing data in the present embodiment include information that specifies a needle drop point for forming a stitch of the embroidery pattern and information that specifies a stitch color, that is, an embroidery thread color. More specifically, the sewing data are a collection of data that include color information that indicates the colors of the embroidery threads that will be used and the order in which the colors will be used (the use order), as well as information that indicates the coordinates of the needle drop points and the stitching order. The color information may include one of a color number that is set in advance for each thread color and an RGB value for each color. In the present embodiment, the embroidery frame 200 can be moved in an X axis direction and a Y axis direction by an embroidery frame moving mechanism 11 that will be described later. Accordingly, the coordinates of the needle drop points are expressed by X and Y coordinates in a coordinate system in which a center position C of the embroidery pattern is defined as a point where the coordinates C (X, Y) are (0, 0). As shown in FIG. 2, at least one type of the sewing data is stored in the sewing data storage area 221 for each of a number n of embroidery patterns.

Positioning data for the embroidery pattern for which the sewing data are stored in the sewing data storage area 221 are stored in the positioning data storage area 222. In the present embodiment, the positioning data include position data and angle data. The position data are information that indicates a positioning position of the embroidery pattern in relation to a reference position within the embroidery frame 200, and the angle data are information that pertains to a positioning angle for positioning the embroidery pattern by rotating the embroidery pattern.

In the present embodiment, the position data are expressed by a distance in the X axis direction and a distance in the Y axis direction (in millimeters) from the reference position to the center position C of the embroidery pattern. In initial settings, the distance in the X axis direction and the distance in the Y axis direction from the reference position to the center position C of the embroidery pattern are both set to zero millimeters. In other words, according to the initial positioning data, the embroidery pattern is positioned within the embroidery frame 200 such that the center position C of the embroidery pattern is aligned with the reference position. Further, in the present embodiment, the angle data are expressed by an angle (degrees) at which the embroidery pattern is rotated, with the reference position as the center of rotation. The X axis direction serves as the reference for the angle, and in the initial settings, the angle of rotation of the embroidery pattern is set to zero degrees.

History data for the embroidery pattern for which the sewing data are stored in the sewing data storage area 221 are stored in the history data storage area 223. The history data are information that indicates the state of progress of the sewing of the embroidery pattern. As described previously, the sewing data are a collection of data that include the color information that indicates the colors of the embroidery threads that will be used and the use order, as well as the information that indicates the coordinates of the needle drop points and the stitching order. Accordingly, if the color information for the embroidery threads and the use order are used as the history data, then the history data can specify that the sewing of the embroidery pattern has been completed up to a given color of the embroidery thread. Furthermore, if the number of the needle drop points is used as the history data, the history data can specify that the sewing of the embroidery pattern has been completed up to a given stitch. Hereinafter, the number of the needle drop points with which a stitch has been sewn is referred to as the stitch count.

A position setting flag is stored in the position setting storage area 224. The position setting flag is a flag that indicates whether the setting of the positioning position and the positioning angle for the embroidery pattern has been completed by the user. Specifically, in a case where the position setting flag is set to 1, it indicates that the setting of the positioning position and the positioning angle for the embroidery pattern has already been completed, and in a ease where the position setting flag is set to 0, it indicates that the setting of the positioning position and the positioning angle for the embroidery pattern has not yet been completed.

As described previously, the frame memory 220 can be accessed from an external device that is connected to the frame storage device 210 through the connector 212. Accordingly, the external device that is connected to the frame storage device 210 through the connector 212 can be used to write information (for example, the sewing data, the positioning data, the history data, and the position setting flag) to the frame memory 220 and to read and use the information from the frame memory 220.

Next, the physical configuration of the multi-needle sewing machine 1 (hereinafter simply called the sewing machine 1), which is an example of a sewing machine to which the embroidery frame 200 can be attached, will be explained with reference to FIGS. 3 to 6. In the explanation that follows, the upper side, the lower side, the lower left side, the upper right side, the upper left side, and the lower right side in FIG. 3 correspond respectively to the upper side, the lower side, the front side, the rear side, the left side, and the right side of the sewing machine 1.

Figure 3:
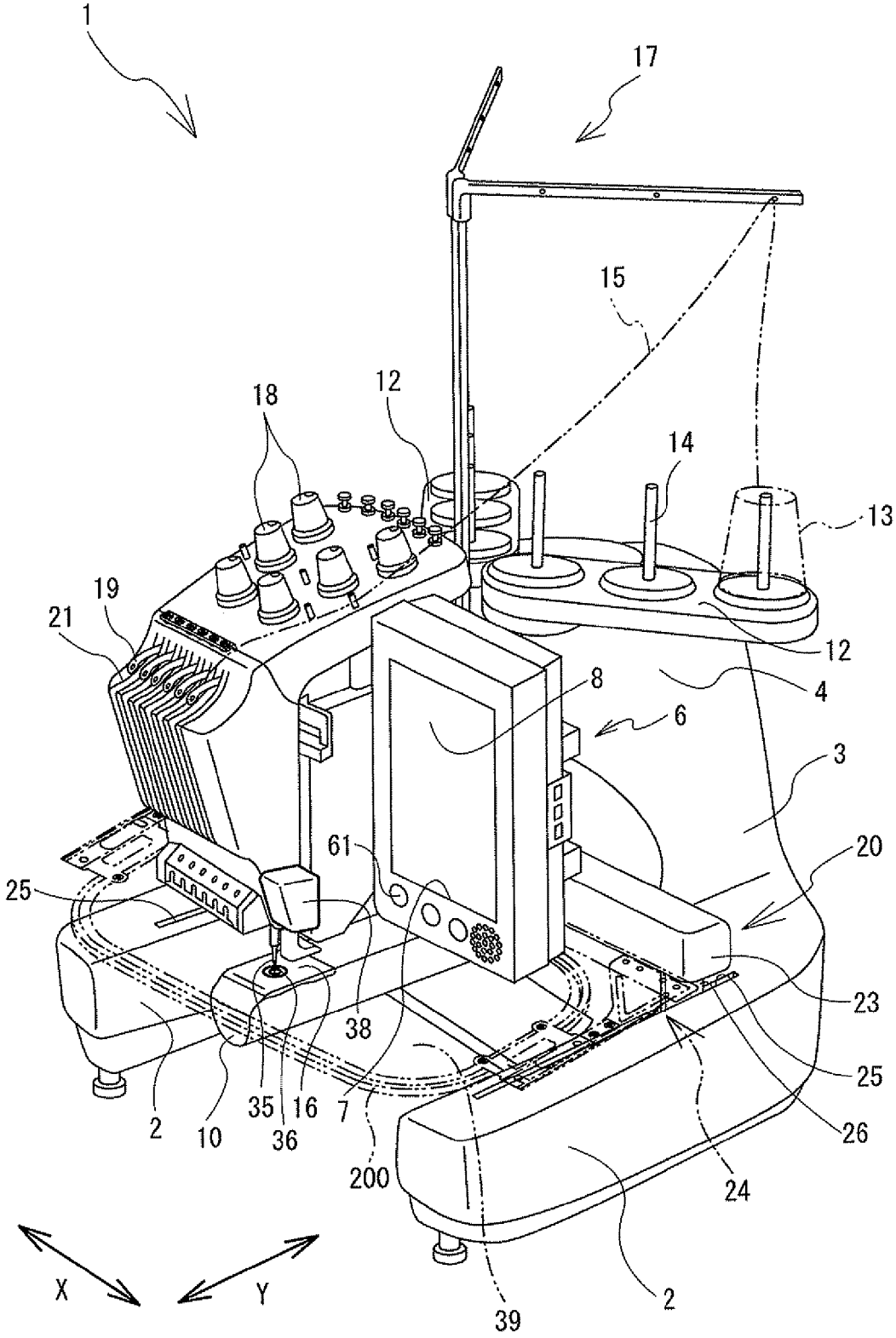
FIG. 3 is an oblique view of a multi-needle sewing machine.

As shown in FIG. 3, the sewing machine 1 includes a supporting portion 2, a pillar 3, and an arm 4. The supporting portion 2 is formed in an inverted U shape in a plan view and supports the entire sewing machine 1. A pair of left and right guide slots 25 that extend in the front-rear direction are provided in the top face of the supporting portion 2. The pillar 3 rises upward from the rear portion of the supporting portion 2. The arm 4 extends forward from the upper end of the pillar 3. A needle bar case 21 is provided on the front end of the arm 4. The needle bar case 21 can be moved to the left and to the right by a needle bar switching mechanism (not shown in the drawings).

Figure 4:
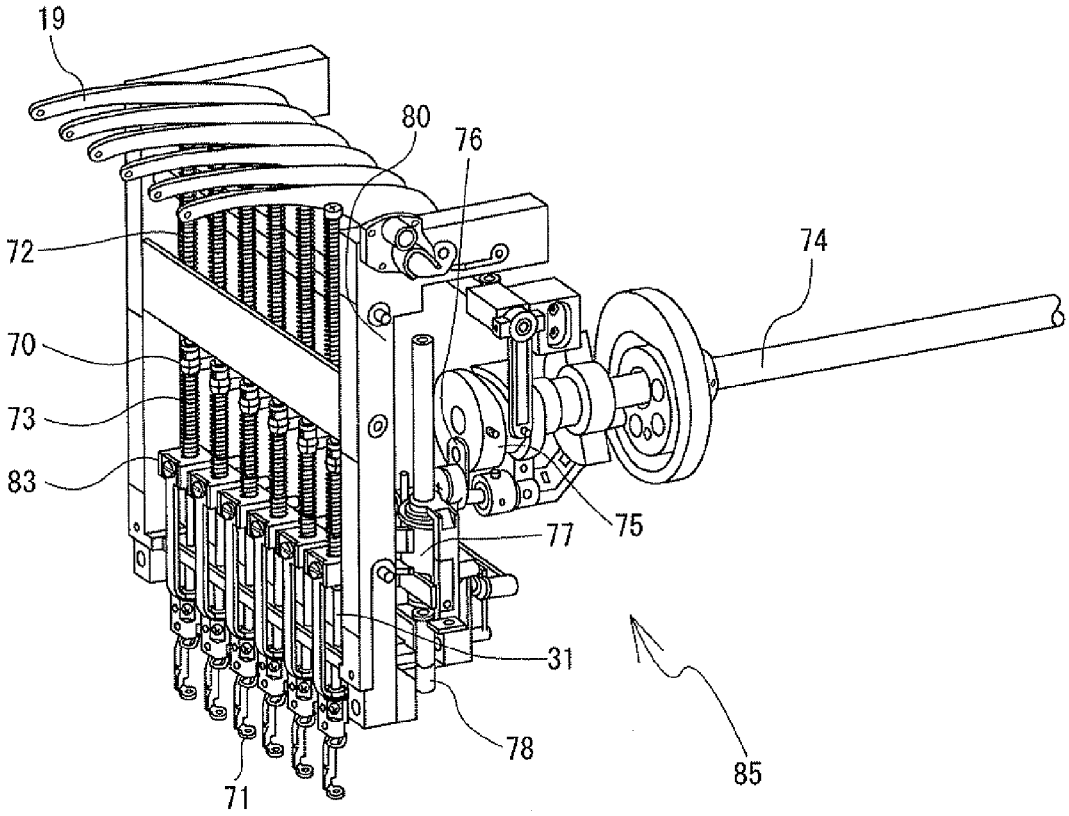
FIG. 4 is an oblique view that shows an interior of a needle bar case.

An internal mechanism of the needle bar case 21 will be explained with reference to FIG. 4. As shown in FIG. 4, six needle bars 31 that extend in the up-down direction are provided inside the needle bar case 21 at equal intervals in the left-right direction. The needle bars 31 are supported by two securing members (not shown in the drawings) that are secured to a frame 80 of the needle bar case 21, such that the needle bars 31 can slide up and down. A hold spring 72 is provided on the upper half of each of the needle bars 31, and a hold spring 73 is provided on the lower half of each of the needle bars 31. A needle bar guide 70 is provided between the hold spring 72 and the hold spring 73. A hold guide 83 is provided below the hold spring 73.

The needle bars 31 are slid up and down by a needle bar drive mechanism 85 that is driven by a sewing machine motor 127 (refer to FIG. 7) serving as a drive source. The needle bar drive mechanism 85 includes a thread take-up lever drive cam 75, a coupling member 76, a transmitting member 77, a guide bar 78, and a coupling pin (not shown in the drawings). Needles 35 (refer to FIG. 3) are respectively attached to the bottom ends of the needle bars 31. A presser foot 71 is formed such that it extends from each of the hold guides 83 to slightly below the bottom end portion (the tip portion) of the corresponding needle 35. Operating in conjunction with the up-and-down movement of the corresponding needle bar 31, the presser foot 71 intermittently presses the work cloth downward.

As shown in FIG. 3, a pair of left and right spool stands 12 are provided at the rear face side of the top face of the arm 4. Three thread spool pins 14 that extend in the up-down direction are provided on each of the spool stand 12. Thread spools 13 can be mounted on the thread spool pins 14. The number of the thread spools 13 that can be placed on the one pair of the spool stands 12 is six, the same as the number of needle bars 31. Upper threads 15 are supplied from the thread spools 13, each of the upper threads 15 being supplied, through a thread guide 17, a tensioner 18, and a thread take-up lever 19, to an eye (not shown in the drawings) of each of the needles 35 that are attached to the bottom ends of the needle bars 31.

An operation portion 6 is provided on the right side of the arm 4 at a central position in the front-rear direction. The operation portion 6 includes a liquid crystal display 7 (hereinafter simply called the LCD 7), a touch panel 8, and operation buttons that include a start-and-stop button 61. An operation screen for a user to input commands, for example, may be displayed on the LCD 7. The touch panel 8 is adapted to accept commands from the user. If the user performs a pressing operation (the operation hereinafter being called a panel operation) on an input key or the like that is displayed on the LCD 7, with one of a finger and a special touch pen, an item that corresponds to the pressed location that is detected by the touch panel 8 is recognized as having been selected. By performing this sort of panel operation, the user can select the embroidery pattern, the sewing conditions, and the like. The start-and-stop button 61 is a button for inputting a command to start sewing and a command to stop sewing.

A cylinder bed 10 that extends toward the front from the bottom end of the pillar 3 and parallel to the arm 4 is provided underneath the arm 4. A shuttle (not shown in the drawings) that holds a bobbin (not shown in the drawings) on which a lower thread (not shown in the drawings) is wound is provided in the interior of the front end of the cylinder bed 10. A shuttle drive mechanism (not shown in the drawings) that rotationally drives the shuttle is also provided in the interior of the cylinder bed 10. A needle plate 16 that is rectangular in a plan view is provided on the top face of the cylinder bed 10. A needle hole 36 through which one of the needles 35 passes is provided in the needle plate 16.

Figure 5:
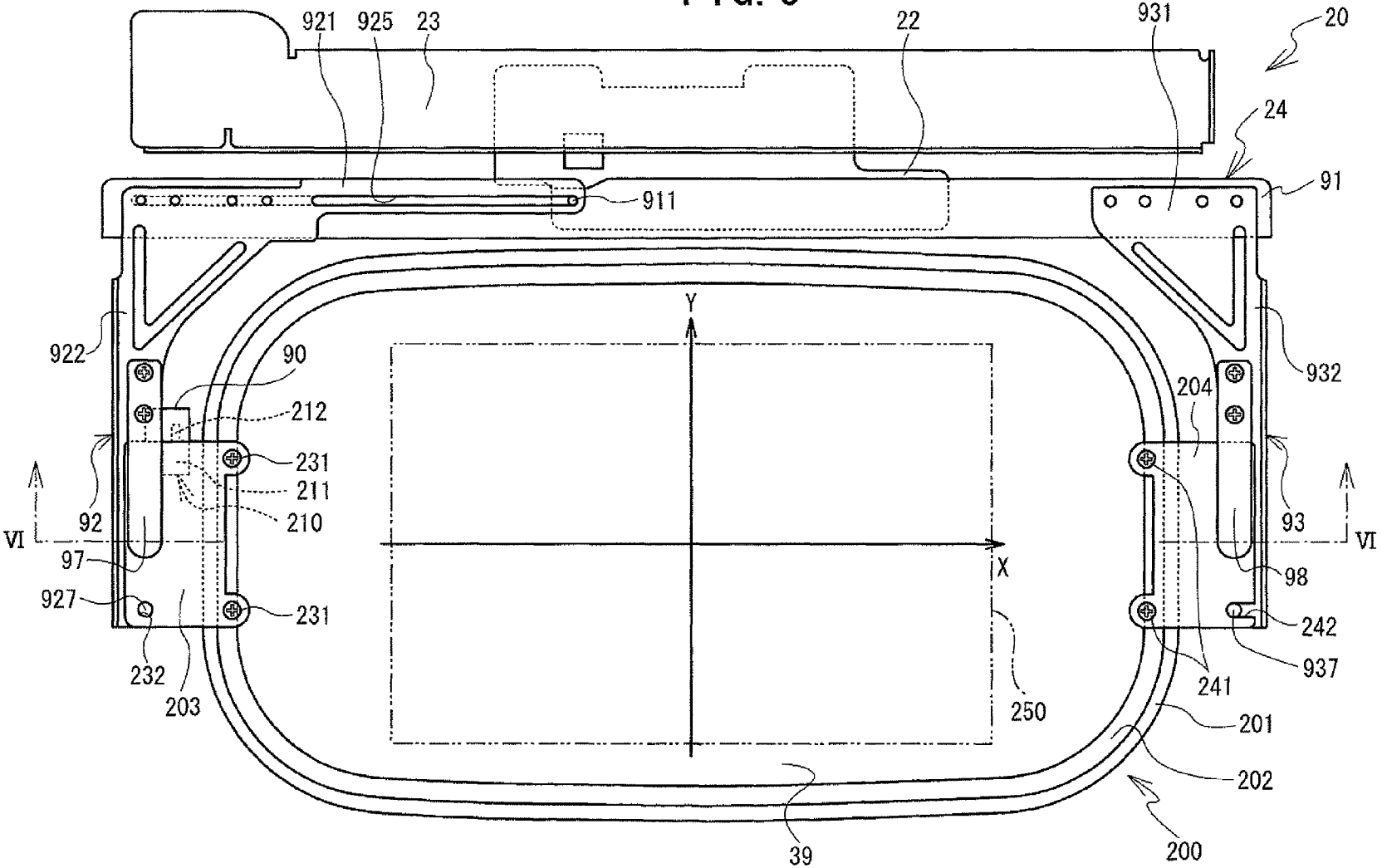
FIG. 5 is a plan view of a carriage to which the embroidery frame is attached.

A carriage 20 of the embroidery frame moving mechanism 11 is provided underneath the arm 4 and above the cylinder bed 10. The embroidery frame moving mechanism 11 will be explained with reference to FIGS. 3, 5, and 6. The embroidery frame moving mechanism 11 includes the carriage 20, an X axis moving mechanism, and a Y axis moving mechanism. As shown in FIG. 5, the carriage 20 includes a Y carriage 23, an X carriage 22 that is attached to the Y carriage 23, and a holder 24 that is attached to the X carriage 22. The Y axis moving mechanism is provided inside the supporting portion 2 and moves the Y carriage 23 toward the front and the rear (in the Y axis direction). The X axis moving mechanism is provided inside the Y carriage 23 and moves the X carriage 22 to the left and to the right (in the X axis direction).

As shown in FIG. 3, the Y carriage 23 has a horizontally long box shape. The Y carriage 23 extends in the left-right direction such that it spans the distance between the left and right sides of the supporting portion 2. The Y carriage 23 supports the X carriage 22 such that the X carriage 22 can move to the left and to the right. The Y axis moving mechanism that is provided inside the supporting portion 2 includes a pair of left and right moving bodies 26, a Y axis motor 134 (refer to FIG. 7), and a linear movement mechanism (not shown in the drawings). The moving bodies 26 are coupled to the bottom portions of the left and right ends of the Y carriage 23 and pass vertically through the guide slots 25 that are provided in the supporting portion 2. The Y axis motor 134 is a stepping motor. The linear movement mechanism includes a timing pulley (not shown in the drawings) and a timing belt (not shown in the drawings), and the linear movement mechanism moves the moving bodies 26 forward and backward (in the Y axis direction) along the guide slots 25 using the Y axis motor 134 as its drive source. This causes the Y carriage 23, which is secured on the moving bodies 26, to move forward and backward (in the Y axis direction).

As shown in FIG. 5, the X carriage 22 is a plate member whose length in the left-right direction is approximately half that of the Y carriage 23. The rear portion of the X carriage 22 is supported by the Y carriage 23 such that the X carriage 22 can slide to the left and to the right (in the X axis direction). The front portion of the X carriage 22 projects toward the front from the bottom of the front face of the Y carriage 23. The X axis moving mechanism that is provided inside the Y carriage 23 includes an X axis motor 132 (refer to FIG. 7) a linear movement mechanism (not shown in the drawings). The X axis motor 132 is a stepping motor. The linear movement mechanism includes a timing pulley (not shown in the drawings) and a timing belt (not shown in the drawings), and the linear movement mechanism moves the X carriage 22 to the left and to the right (in the X axis direction) using the X axis motor 132 as its drive source.

The holder 24 is attached to the front portion of the X carriage 22 and is adapted to detachably support the embroidery frame 200. The holder 24 includes a main portion 91, a right supporting portion 93, and a left supporting portion 92. The main portion 91 is a plate member that is rectangular in a plan view and whose length in the left-right direction is approximately the same as that of the Y carriage 23. The central portion of the main portion 91 is attached to the X carriage 22. An upwardly projecting guide pin 911 is provided on the top face of the main portion 91, slightly to the left of the center in the left-right direction.

The right supporting portion 93 is a plate member and includes a base portion 931 and a right arm portion 932. The base portion 931 overlaps and is immovably attached to the top face of the right portion of the main portion 91. The right arm portion 932 extends toward the front from the base portion 931. An upwardly projecting engaging pin 937 is provided on the top face of the front end of the right arm portion 932. A flat spring 98 is provided to the rear of the engaging pin 937 of the right arm portion 932. The flat spring 98 is secured by screws to the rear portion of the top face of the right arm portion 932. When the embroidery frame 200 is attached to the holder 24, the right connecting portion 204 of the embroidery frame 200 is held between and supported by the right arm portion 932 and the flat spring 98. The engaging pin 937 engages the engaging slot 242 that is provided in the right connecting portion 204.

The left supporting portion 92 is a plate member and includes a base portion 921 and a left arm portion 922. The base portion 921 overlaps and is movably attached to the top face of the left portion of the main portion 91. The left arm portion 922 extends toward the front from the base portion 921. The left supporting portion 92 has a shape that is almost bilaterally symmetrical to the right supporting portion 93, but the length of the base portion 921 is longer than that of the base portion 931. The base portion 921 has a guide slot 925 that extends along the main portion 91 in the left-right direction. The guide pin 911 of the main portion 91 is inserted through the guide slot 925. Therefore, the left supporting portion 92 can slide in the left-right direction along the main portion 91 for the length of the guide slot 925.

A securing mechanism for selectably positioning the left supporting portion 92 in a plurality of specific positions in the left-right direction is provided in the main portion 91, although it is not shown in the drawings. In addition to the embroidery frame 200 that is shown in FIG. 5, a plurality of types of other embroidery frames of different sizes and shapes can each be attached to the sewing machine 1. Accordingly, by operating the securing mechanism, the user can position and secure the left supporting portion 92 in one of the plurality of specific positions, according to the size of the embroidery frame that is used.

An upwardly projecting engaging pin 927 is provided on the top face of the front end of the left arm portion 922. A flat spring 97 is provided to the rear of the engaging pin 927 of the left arm portion 922. The flat spring 97 is secured by screws to the rear portion of the top face of the left arm portion 922. When the embroidery frame 200 is attached to the holder 24, the left connecting portion 203 of the embroidery frame 200 is held between and supported by the left arm portion 922 and the flat spring 97. The engaging pin 927 engages the engaging hole 232 that is provided in the left connecting portion 203.

A holder connector 90 that can be connected to the connector 212 of the frame storage device 210 of the embroidery frame 200 is provided on the bottom face of a central portion of the left arm portion 922 in the front-rear direction, projecting rightward from the left arm portion 922. The holder connector 90 is connected to a control portion 100 of the sewing machine 1 (refer to FIG. 7) by wiring that is not shown in the drawings. The front edge of the holder connector 90 is disposed such that it is at the same position as the rear edge of the left connecting portion 203 in the front-rear direction, when the embroidery frame 200 is properly attached to the holder 24, as shown in FIG. 5. Note that in a case where the frame storage device 210 is configured from a USB memory, the holder connector 90 may be a USB connector.

Figure 6:
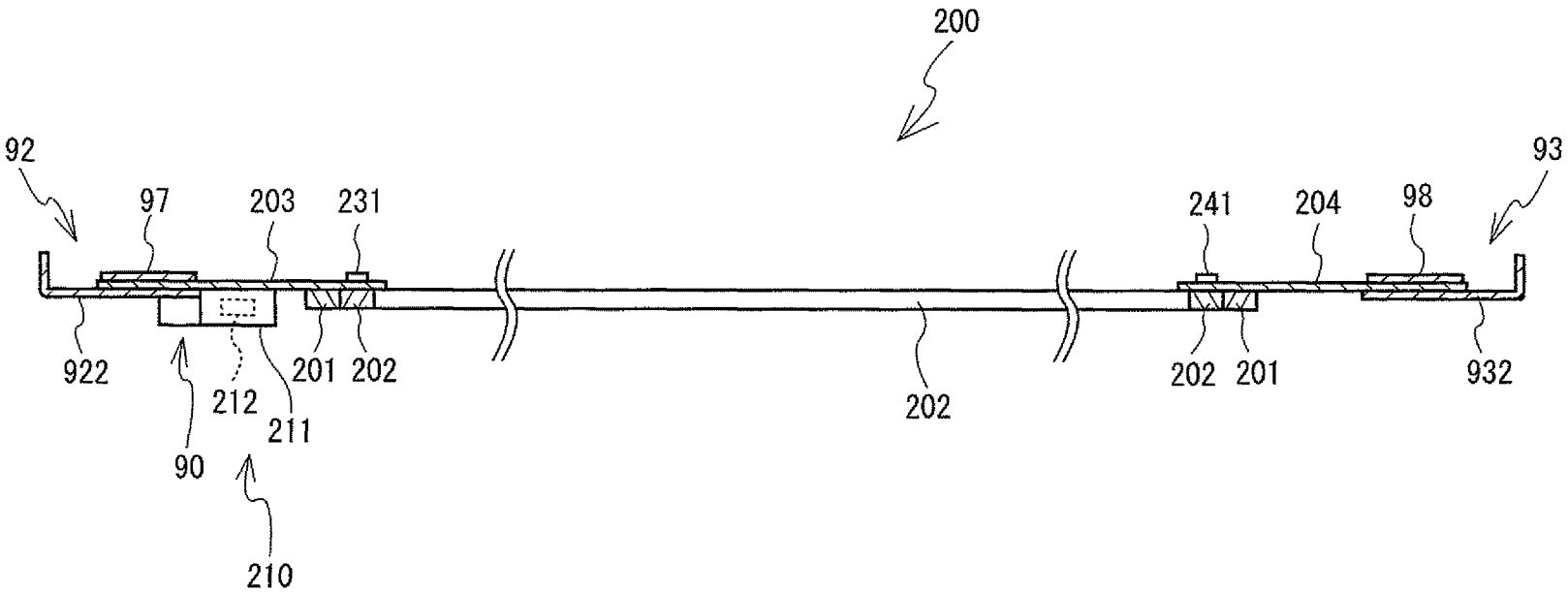
FIG. 6 is a sectional view along a line VI-VI in FIG. 5.

When attaching the embroidery frame 200 to the holder 24, the user first secures the left supporting portion 92 in an appropriate position in the left-right direction. The user then inserts the left and right connecting portions 203 and 204 of the embroidery frame 200 between the left arm portion 922 and the flat spring 97 and between the right arm portion 932 and the flat spring 98, respectively, as shown in FIGS. 5 and 6. Next, the user engages the engaging pin 927 of the left arm portion 922 in the engaging hole 232 of the left connecting portion 203 and engages the engaging pin 937 of the right arm portion 932 in the engaging slot 242 of the right connecting portion 204. The embroidery frame 200 is thus attached to an appropriate position in the holder 24.

As the embroidery frame 200 is attached to the holder 24, the connector 212 of the frame storage device 210, which projects toward the rear from the rear edge of the left connecting portion 203, gets connected to the holder connector 90, and the two connectors are connected such that wired communication is enabled between them. This makes it possible for information such as the sewing data and the like that are stored in frame memory 220 to be read and utilized by the sewing machine 1. Information that has been stored in the sewing machine 1 can also be written to the frame memory 220.

The electrical configuration of the sewing machine 1 will be explained with reference to FIG. 7. As shown in FIG. 7, the sewing machine 1 includes the control portion 100, which performs overall control of the sewing machine 1. The control portion 100 includes a CPU 101, a ROM 102, a RAM 103, an EEPROM 104, and an input/output interface (I/O) 105, all of which are connected to one another through a bus. Drive circuits 121 to 126, the touch panel 8, the start-and-stop button 61, and the holder connector 90 are connected to the I/O 105.

The CPU 101 performs main control of the sewing machine 1 and performs various types of computations and processing that are related to sewing, in accordance with various types of programs for operating the sewing machine 1 that are stored in a program storage area (not shown in the drawings) in the ROM 102. The programs may also be stored in an external storage device such as a flexible disk or the like. The ROM 102 has a plurality of storage areas that include the program storage area and a pattern storage area, although these are not shown in the drawings. The sewing data for sewing on the sewing machine 1 various types of embroidery patterns (internally stored patterns) that can be selected by the user are stored in the pattern storage area. The RAM 103 is a storage element from which data can be read and to which data can be written as desired. Storage areas for holding computation results and the like that are obtained through computation processing by the CPU 101 are provided in the RAM 103 as necessary. The EEPROM 104 is a storage element from which data can be read and to which data can be written. Various types of parameters for the various types of processing that is performed by the sewing machine 1 are stored in the EEPROM 104.

The drive circuit 121 is connected to the sewing machine motor 127 and drives the sewing machine motor 127 in accordance with a control signal from the CPU 101. The sewing machine motor 127 drives the needle bar drive mechanism 85 and the shuttle drive mechanism (not shown in the drawings) by rotating a drive shaft 74 (refer to FIG. 4). The drive circuit 122 is connected to a needle bar switching motor 128 and drives the needle bar switching motor 128 in accordance with a control signal from the CPU 101. The needle bar switching motor 128 moves the needle bar case 21 to the left and to the right by driving the needle bar switching mechanism (not shown in the drawings). The drive circuit 123 is connected to a cutting mechanism motor 129 and drives the cutting mechanism motor 129 in accordance with a control signal from the CPU 101. The cutting mechanism motor 129 drives a cutting mechanism (not shown in the drawings) that cuts the upper threads 15 (refer to FIG. 3) that are supplied to the needles 35.

The drive circuits 124 and 125 are respectively connected to the X axis motor 132 and the Y axis motor 134 and drive the motors in accordance with control signals from the CPU 101. The X axis motor 132 moves the embroidery frame 200 to the left and to the right by moving the previously described X carriage 22 (refer to FIG. 5) to the left and to the right (in the X axis direction). The Y axis motor 134 moves the embroidery frame 200 toward the front and toward the rear by moving the previously described moving bodies 26 (refer to FIG. 3) toward the front and toward the rear (in the Y axis direction). The drive circuit 126 is connected to the LCD 7 and drives the LCD 7 in accordance with a control signal from the CPU 101. The holder connector 90, as described above, gets connected to the connector 212 of the frame storage device 210 when the embroidery frame 200 is attached to the holder 24.

The operation of the sewing machine 1 that forms stitches in a work cloth 39 that is held in the embroidery frame 200 will be explained with reference to FIGS. 3 to 5. The embroidery frame 200 that holds the work cloth 39 is supported by the holder 24. One of the six needle bars 31 that will be driven up and down is positioned directly above the needle hole 36 (refer to FIG. 3) by using the needle bar switching mechanism (not shown in the drawings) that is driven by the needle bar switching motor 128 (refer to FIG. 7) to move the needle bar case 21 to one of the left and the right. The embroidery frame 200 is moved to a specified position by the embroidery frame moving mechanism 11. The needle bar drive mechanism 85 is driven when the drive shaft 74 is rotated by the sewing machine motor 127.

More specifically, the rotational drive of the drive shaft 74 is transmitted to the coupling member 76 through the thread take-up lever drive cam 75. The transmitting member 77, on which the coupling member 76 pivots, is driven up and down, being guided by the guide bar 78, which is positioned at the level of the needle bar 31. The up-and-down movement of the transmitting member 77 is transmitted to the needle bar 31 through a coupling pin (not shown in the drawings), and the needle bar 31, to which the needle 35 is attached, is driven up and down. Through a link mechanism that is not shown in the drawings, the thread take-up lever 19 is driven up and down by the rotation of the thread take-up lever drive cam 75. The rotation of the drive shaft 74 is also transmitted to the shuttle drive mechanism (not shown in the drawings) inside the cylinder bed 10, and the shuttle (not shown in the drawings) is rotationally driven. Thus the needle 35, the thread take-up lever 19, and the shuttle are driven in synchronization, and a stitch is formed in the work cloth 39.

Figure 8:
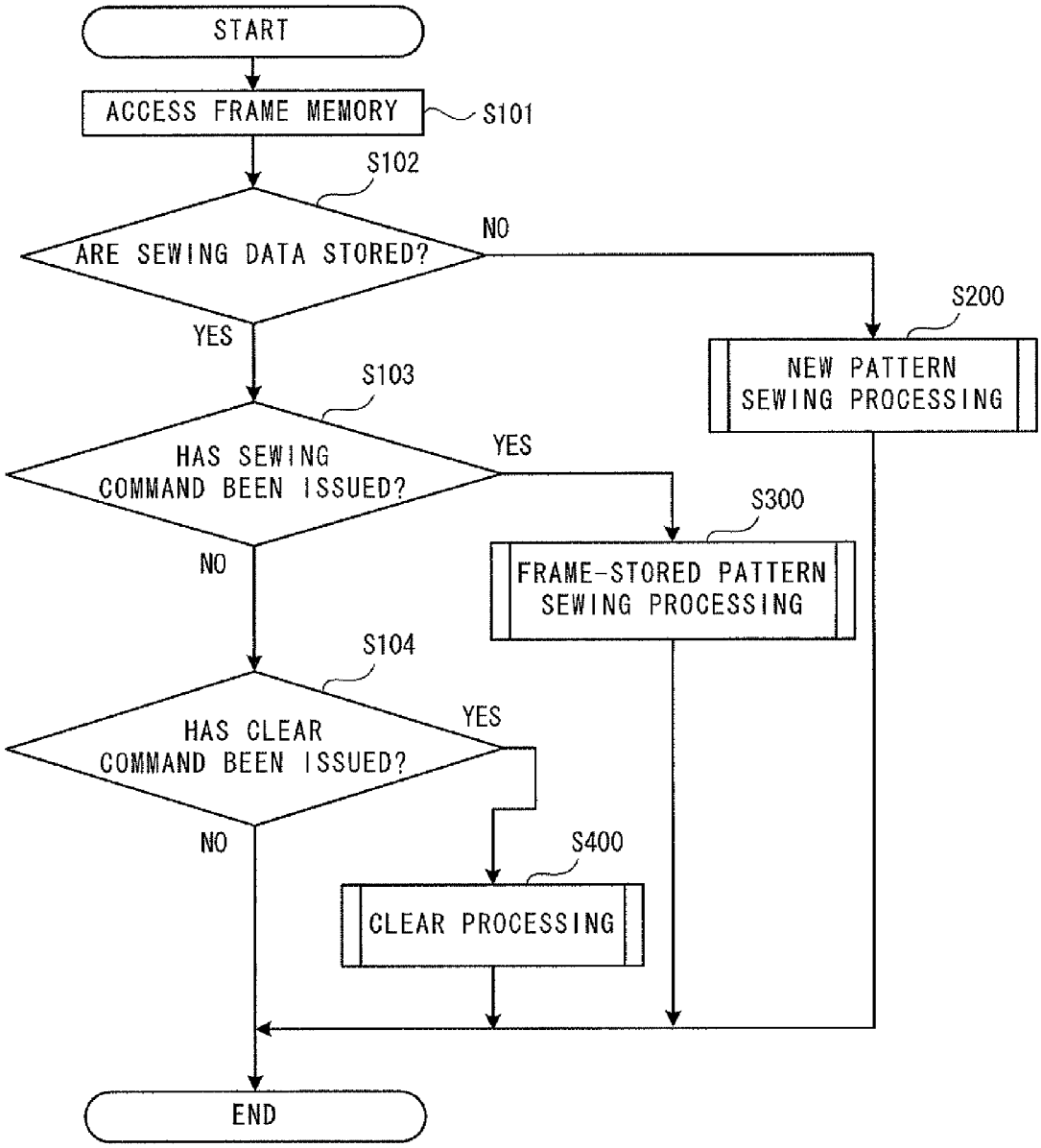
FIG. 8 is a flowchart of main processing that is performed in the multi-needle sewing machine.

The processing that is performed when the embroidery pattern is sewn by the sewing machine 1 will be explained with reference to FIGS. 8 to 10. The processing that is hereinafter explained is performed by the CPU 101 in accordance with the programs that are stored in the ROM 102. Main processing that is shown in FIG. 8 is started when the power supply for the sewing machine 1 has been turned on, the embroidery frame 200 has been attached to the holder 24 of the sewing machine 1, and the CPU 101 detects that the connector 212 of the frame storage device 210 is connected to the holder connector 90.

The CPU 101 accesses the frame memory 220 (refer to FIG. 7) through the holder connector 90 and the connector 212 (Step S101) and determines whether the sewing data are stored in the sewing data storage area 221 of the frame memory 220 (refer to FIG. 2) (Step S102). In a case where the sewing data are not stored in the sewing data storage area 221 (NO at Step S102), the information that specifies the embroidery pattern that is to be sewn is not stored in the frame memory 220. Accordingly, new pattern sewing processing, in which the embroidery pattern is selected by the user and sewn, (refer to FIG. 9) is performed (Step S200).

Figure 9:
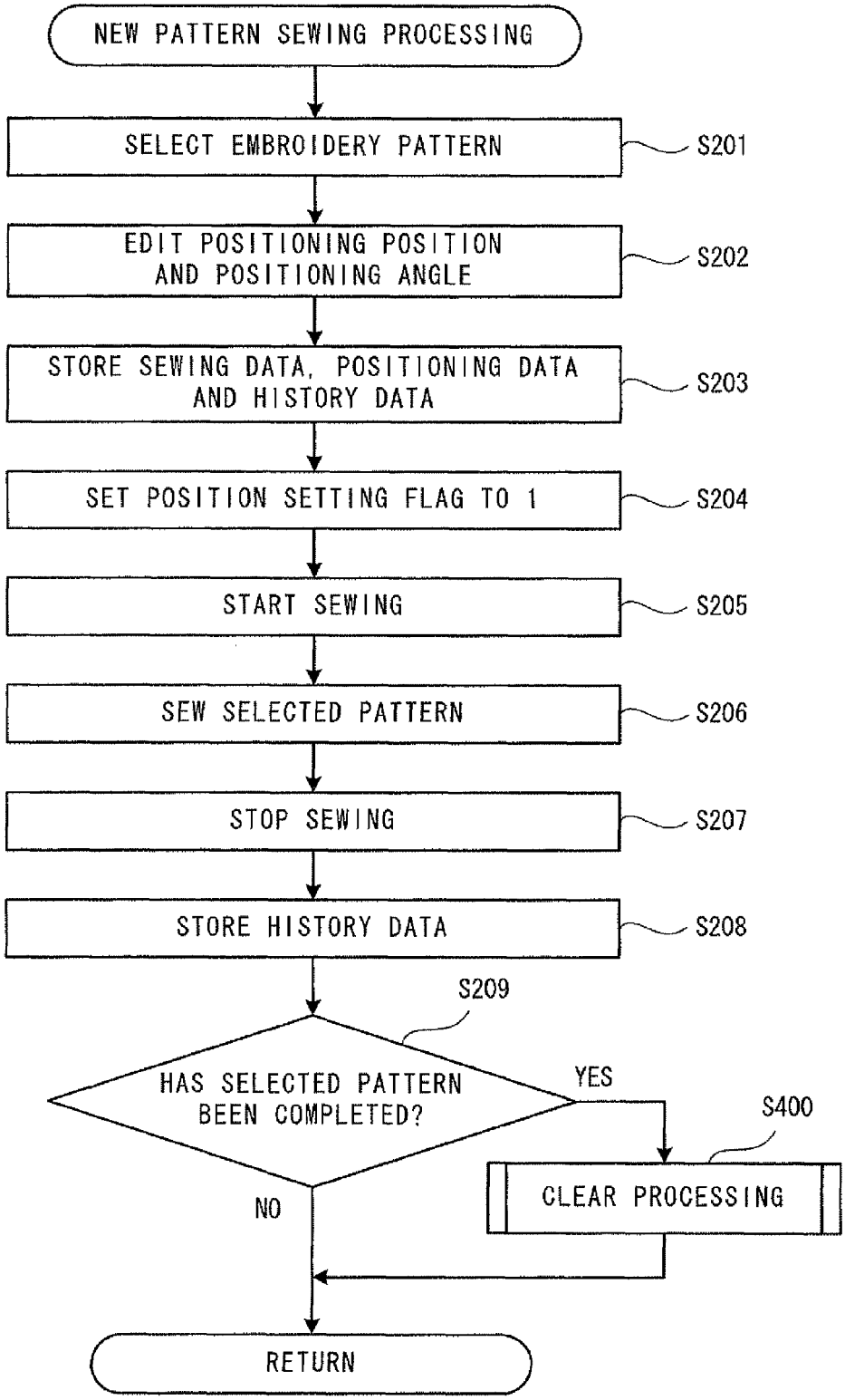
FIG. 9 is a flowchart of new pattern sewing processing that is performed in the main processing.

As shown in FIG. 9, in the new pattern sewing processing, information on the embroidery pattern that is selected by the user is accepted (Step S201). More specifically, first, a list of the internally stored patterns in the sewing machine 1 is displayed on the LCD 7 such that a pattern can be selected. The user uses a panel operation to select one of the patterns. The embroidery pattern that is selected by the user (hereinafter called the selected pattern) is specified in accordance with the position on the touch panel 8 that has been pressed, and the sewing data for the selected pattern are read from the ROM 102 into the RAM 103. The sewing machine 1 can sew a combination of a plurality of the internally stored patterns that are selected by the user. In that case, after the user has selected a merge button that is provided on an edit screen (not shown in the drawings) that is displayed on the LCD 7, the user may select a plurality of the internally stored patterns as desired. The sewing data for the plurality of the selected patterns are then read into the RAM 103.

Next, editing of the positioning position and the positioning angle for the selected pattern is performed (Step S202). For example, an edit screen (not shown in the drawings) that shows keys and the like for editing the positioning position and the positioning angle for the selected pattern is displayed on the LCD 7. An eight-direction move key for editing the position and an angle setting key for editing the angle are provided on the edit screen. The positioning position and the positioning angle may be edited in accordance with panel operations by the user. In a case where there is a plurality of selected patterns, the editing of the positioning positions and the positioning angles is possible for each of the selected patterns.

In an embroidery coordinate system of the sewing machine 1, as shown in FIG. 5, the left-right direction that is the movement direction of the X carriage 22 is the X axis direction, and the front-rear direction that is the movement direction of the Y carriage 23 is the Y axis direction. The position at which the center of a sewing area 250 is aligned with the center of the needle hole 36 (refer to FIG. 3) is defined as an origin point O where the coordinates (X, Y) are (0, 0). Note that the sewing area 250 may be set within the inner frame 202 in accordance with the type of the embroidery frame 200. The positioning position of the embroidery pattern is set using the position of the origin point as a reference position, and the positioning angle is set as the angle of rotation around the origin point position in relation to the X axis.

As described previously, in the sewing data, the coordinates of the center position C of the embroidery pattern are defined as C (X, Y)=(0, 0), so the center position C is aligned with the origin point O. Therefore, when the center position C is moved, the distance that the center position C is moved from the origin point O in the X axis direction and the distance that the center position C is moved from the origin point O in the Y axis direction are computed in accordance with the operation of the move key. The angle of rotation around the origin point O in relation to the X axis is computed in accordance with the operation of the angle setting key. When an edit end button that is displayed on the edit screen is selected by a panel operation, the positioning position (the distances moved) and the positioning angle (the angle of rotation) are set. In a case where the edit end button is selected without the move key and the angle setting key having been operated, the distances moved and the angle of rotation are set to initial values of zero millimeters and zero degrees, respectively.

The CPU 101 accesses the frame memory 220 and stores in the frame memory 220 the sewing data for the selected pattern that were read into the RAM 103 at Step S201, the positioning data that were determined at Step S202, and the history data that indicate the state of progress of the sewing of the selected pattern (Step S203). More specifically, the CPU 101 stores the sewing data in the sewing data storage area 221. The data that indicate the distance that has been moved in the X axis direction and the distance that has been moved in the Y axis direction are stored as the position data in the positioning data storage area 222. The data that indicate the angle of rotation are stored as the angle data in the positioning data storage area 222. In a case where there are a number n of the selected patterns, the sewing data, the position data, and the angle data are stored for each of the selected patterns, as shown in FIG. 2. Furthermore, because the sewing of the selected pattern has not yet been started, an initial value (for example, zero) is stored as the history data in the history data storage area 223.

The setting of the positioning position and the positioning angle for the selected pattern has been completed by the user, so the CPU 101 sets the position setting flag to 1 and stores it in the position setting storage area 224 of the frame memory 220 (Step S204).

If the CPU 101 detects that the start-and-stop button 61 that is provided in the operation portion 6 (refer to FIG. 3) has been pressed, the CPU 101 starts the sewing of the selected pattern (Step S205). The CPU 101 sequentially reads the data that are included in the sewing data and performs the sewing of the selected pattern by controlling the various mechanisms of the sewing machine 1 (Step S206). Specifically, the processing that is hereinafter described is performed. The needle bar switching motor 128 (refer to FIG. 7) is operated such that, one of the six needle bars 31 is selected to which is attached the needle 35 to which is supplied the embroidery thread (the upper thread 15) of the color that is specified by the first color information in the sewing data.

The carriage 20 is moved by operating the X axis motor 132 and the Y axis motor 134 (refer to FIG. 7), in turn moving the embroidery frame 200 to a position that is defined by the coordinates of the first needle drop point. In a case where at least one of the positioning angle and the positioning position has been edited at Step S202 and assigned a value other than the initial value, the embroidery frame 200 is moved after the coordinates of the needle drop point have been corrected in accordance with the positioning data. When the drive shaft 74 is rotationally driven by the sewing machine motor 127, the needle bar drive mechanism 85 and the shuttle drive mechanism (not shown in the drawings) are driven, and a stitch is formed. After all of the stitches that are supposed to be sewn with the same embroidery thread have been formed in accordance with the stitching order, the color information for the next embroidery thread is read. The needle bar 31 for the embroidery thread that corresponds to the color information is selected, and the stitches are formed in the same manner.

In a case where the CPU 101 has determined that a command to stop the sewing has been issued, the CPU 101 stops the sewing by stopping the operating of the sewing machine motor 127 and the like (Step S207). In the present embodiment, the CPU 101 determines that a command to stop the sewing has been issued in a case where the CPU 101 detects that the start-and-stop button 61 has been pressed, in a case where the sewing of the selected pattern has been completed, and in a case where a thread change is required. After stopping the sewing, the CPU 101 accesses the frame memory 220 and stores the history data in the history data storage area 223 (Step S208). Specifically, in a case where the history data specifies that the sewing has been completed up to a specific color, for example, the CPU 101 stores data that specify the color information for the embroidery thread for which the sewing has been completed and its use order. In a case where the history data specifies that the sewing has been completed up to a specific stitch, the CPU 101 stores the stitch counts.

The CPU 101 determines whether the sewing of the selected pattern has been completed, that is, whether the selected pattern has been completed (Step S209). If the stitch at the last needle drop point in the stitching order for the last color in the use order has not been formed, the CPU 101 determines that the sewing of the selected pattern has not been completed (NO at Step S209). In that case, the new pattern sewing processing is terminated in a state in which the sewing data, the positioning data, and the history data for the selected pattern has been stored in the frame memory 220 in the processing that is described above, and the position setting flag has been set to 1.

If the stitch at the last needle drop point in the stitching order for the last color in the use order has been formed, the CPU 101 determines that the sewing of the selected pattern has been completed (YES at Step S209). In that case, the data that were stored in the frame memory 220 at Step S203 and the like may no longer be needed by the user, so clear processing for clearing the data from the frame memory 220 (refer to FIG. 11) is performed in accordance with a command from the user (Step S400).

Figure 11:
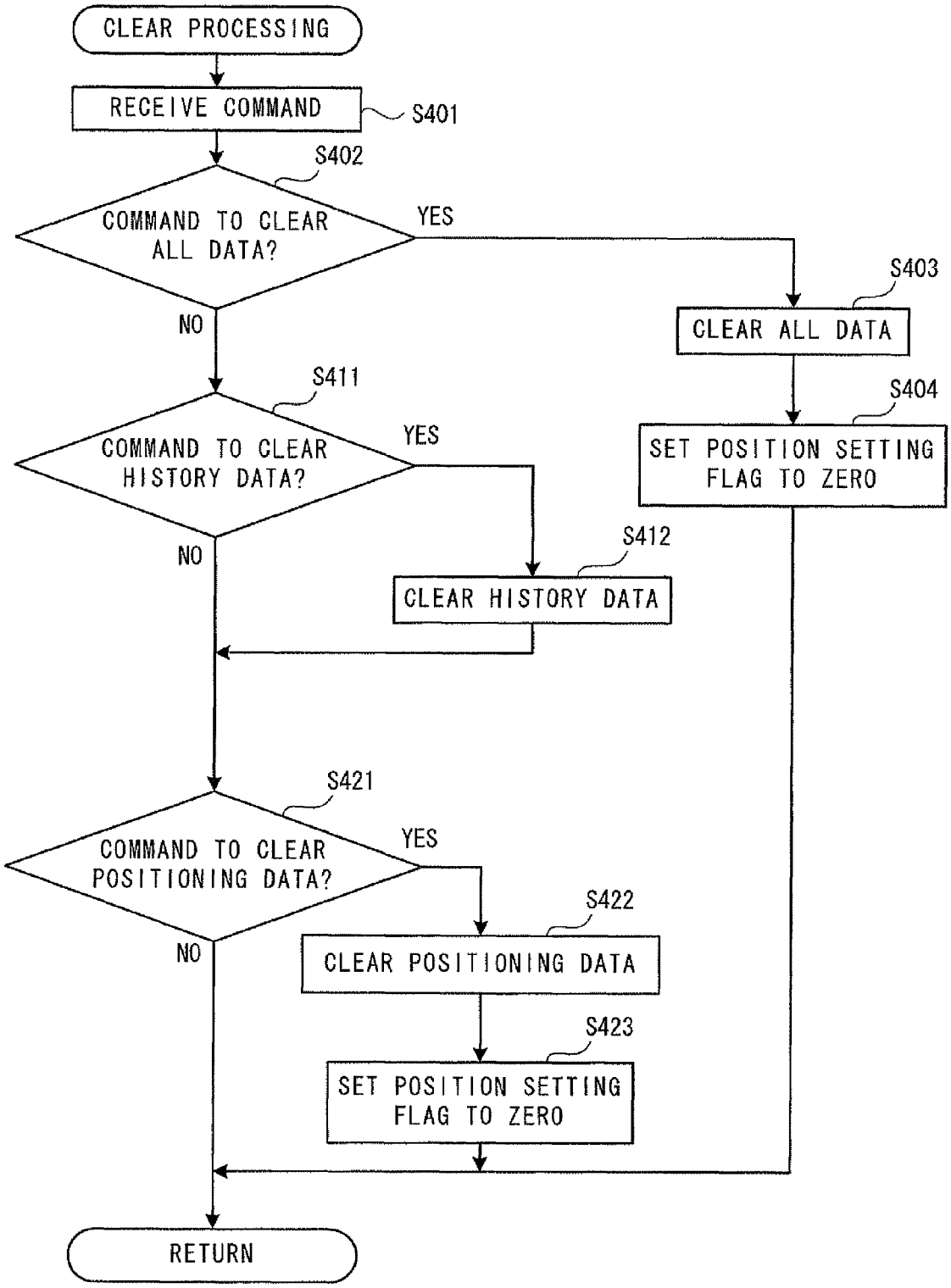
FIG. 11 is a flowchart of clear processing that is performed in the main processing, the new pattern sewing processing, and the frame-stored pattern sewing processing.

As shown in FIG. 11, in the clear processing, the data that are to be cleared will differ according to what command is issued. When the clear processing is started, a command input screen (not shown in the drawings) is displayed on the LCD 7. For example, buttons are provided that allow at least one of the sewing data, the positioning data, and the history data to be selected, but that do not allow only the sewing data to be selected, and a clear button and a save button are also provided. A command that is input by the user using a panel operation is accepted (Step S401).

In a case where the user selects the clear button after selecting all of the sewing data, the positioning data, and the history data, the CPU 101 determines that a command has been issued to clear all of the data (YES at Step S402). In this case, the CPU 101 clears all of the sewing data that are stored in the sewing data storage area 221 of the frame memory 220, the positioning data (the position data and the angle data) that are stored in the positioning data storage area 222, and the history data that are stored in the history data storage area 223 by restoring the initial values for the data (Step S403). Because the settings for the positioning position and the positioning angle have been cleared, the CPU 101 sets to zero the position setting flag that is stored in the position setting storage area 224 (Step S403). The CPU 101 then terminates the clear processing and returns to the new pattern sewing processing shown in FIG. 9.

In a case where the user selects the clear button after selecting the history data, the CPU 101 determines that a command has been issued to clear the history data (NO at Step S402; YES at Step S411). In this case, the CPU 101 clears the history data that are stored in the history data storage area 223 of the frame memory 220 by restoring the initial values for the data (Step S412).

Thereafter, in a case where the user has selected the clear button after selecting the positioning data, the CPU 101 determines that a command has been issued to clear the positioning data (YES at Step S421). Further, in a case where the user selects the clear button after selecting the positioning data, without having selected the history data (NO at Step S411), the CPU 101 determines that a command has been issued to clear the positioning data (YES at Step S421). In these cases, the CPU 101 clears the positioning data that are stored in the positioning data storage area 222 of the frame memory 220 by restoring the initial values for the data (Step S422). Because the settings for the positioning position and the positioning angle have been cleared, the CPU 101 sets to zero the position setting flag that is stored in the position setting storage area 224 (Step S423). The CPU 101 then terminates the clear processing and returns to the new pattern sewing processing shown in FIG. 9.

In a case where the user selects the save button without selecting any of the data (NO at Step S402; NO at Step S411; NO at Step S421), it means that a command has been issued not to clear any of the data, so the CPU 101 terminates the clear processing and returns to the new pattern sewing processing shown in FIG. 9.

After terminating the clear processing (Step S400), the CPU 101 terminates the new pattern sewing processing, as shown in FIG. 9, returns to the main processing that is shown in FIG. 8, and terminates the main processing.

In the main processing that is shown in FIG. 8, in a case where it is determined that the sewing data are stored in the frame memory 220 (YES at Step S102) and that a sewing command has been issued (YES at Step S103), frame-stored pattern sewing processing (refer to FIG. 10) is performed (Step S300). The frame-stored pattern sewing processing is processing that performs the sewing in accordance with the sewing data and the like that are stored in the frame memory 220. At step S103, in a case where an item called "sew embroidery pattern that is stored in embroidery frame" is selected on a menu screen that is displayed on the LCD 7, it may be determined that a sewing command has been issued to sew an embroidery pattern (hereinafter called the stored pattern) that is indicated by the data that are stored in the frame memory 220.

Figure 10:
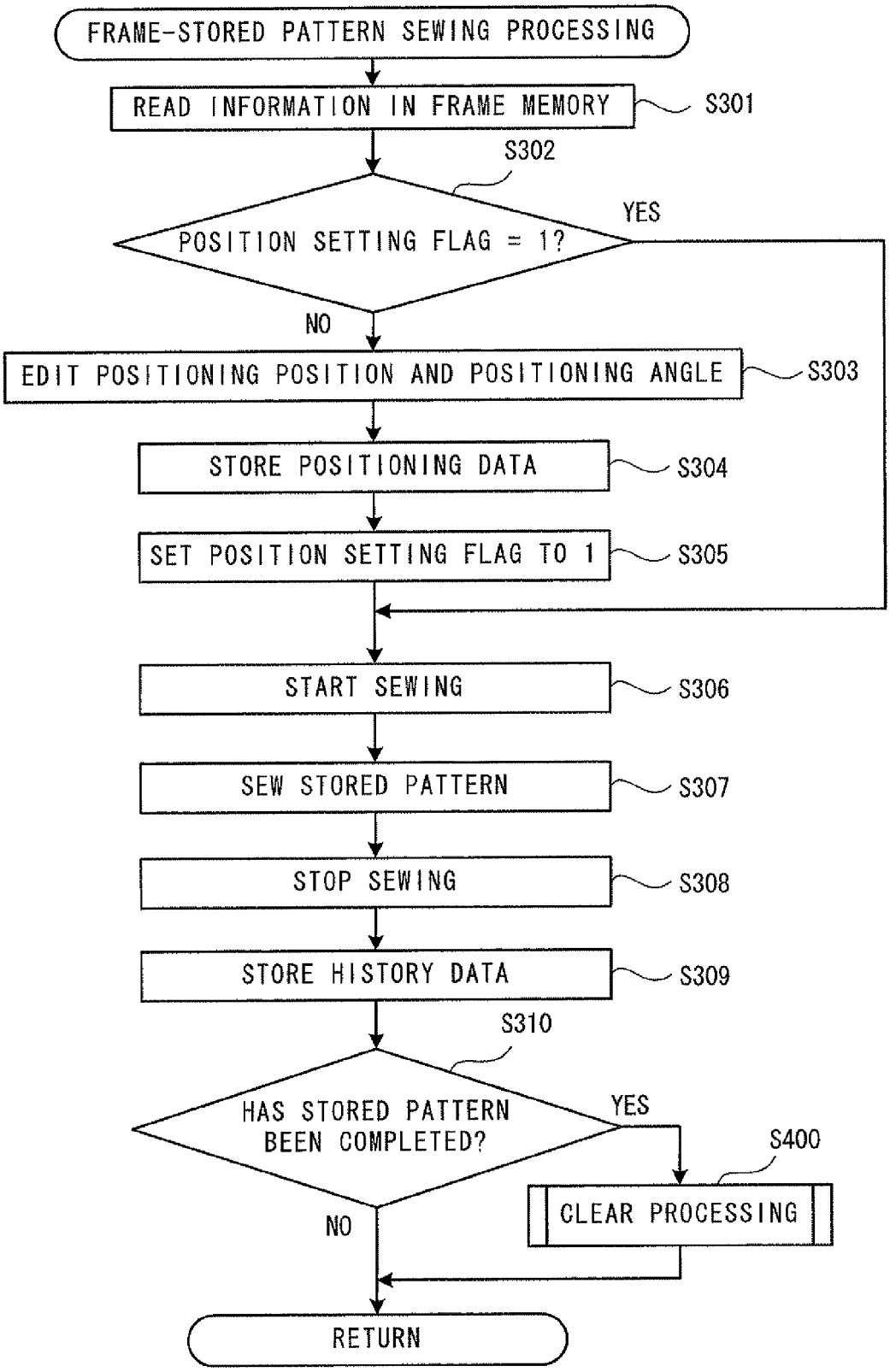
FIG. 10 is a flowchart of frame-stored pattern sewing processing that is performed in the main processing.

In the frame-stored pattern sewing processing, as shown in FIG. 10, the CPU 101 reads all of the data that are stored in the frame memory 220 into the RAM 103 (Step S301). More specifically, the sewing data, the positioning data, the history data, and the position setting flag are read.

The sewing data that are read at Step S301 are one of the sewing data for the selected pattern that were stored at Step S201 of the new pattern sewing processing (refer to FIG. 9) and sewing data that were created in an embroidery data processing device 500 that will be described later (refer to FIG. 12) and stored in the frame memory 220. The history data indicate the initial values in a case where the sewing has not yet been started, as well as in a case where the history data have been cleared by the clear processing (refer to FIG. 11). On the other hand, in a case where the sewing was interrupted before the embroidery pattern was completed, and in a case where the history data for a pattern for which the sewing has been completed were not cleared by the clear processing, the history data are the data that specify the color information for the embroidery threads for which the sewing has been completed and the order in which they were used, or the data that specify the stitch counts.

The positioning data indicate the initial values in a case where the positioning position and the positioning angle have not been edited, as well as in a case where the positioning data have been cleared by the clear processing (refer to FIG. 11). On the other hand, in a case where at least one of the positioning position and the positioning angle has been edited and has not been cleared by the clear processing, the positioning data are data that indicate the positioning position and the positioning angle after the editing. The position setting flag is zero in a case where the positioning data have not been set. Note that the position setting flag is also zero in a case where the sewing data have been created by the embroidery data processing device 500 that will be described later, because the positioning data are never set in the embroidery data processing device 500. On the other hand, in a case where the positioning data have been set, the position setting flag is 1.

After the data have been read from the frame memory 220 (Step S301), a determination is made as to whether the position setting flag is 1 (Step S302). In a case where the position setting flag is zero (NO at Step S302), the user may want to edit the positioning position and the positioning angle. Accordingly, the CPU 101 enables editing by the user by displaying the edit screen on the LCD 7 in the same manner as at Step S202 of the new pattern sewing processing (refer to FIG. 9). When the edit end button is selected and the positioning position and the positioning angle are set (S303), the CPU 101 stores the positioning data in the positioning data storage area 222 of the frame memory 220 (Step S304). The CPU 101 then sets the position setting flag in the position setting storage area 224 to 1 (Step S305). Thereafter, if the start-and-stop button 61 is pressed, the CPU 101 starts the sewing (Step S306).

In a case where the position setting flag that is stored in the frame memory 220 is 1 (YES at Step S302), it means that the user has already finished setting the positioning position and the positioning angle as desired and stored them. Accordingly, if the start-and-stop button 61 is pressed, the CPU 101 starts the sewing (Step S306).

In the frame-stored pattern sewing processing, the sewing of the stored pattern is performed in accordance with the sewing data and the history data that were read from the frame memory 220 at Step S301 (Step S307). The data that are read first from the sewing data will differ according to the state of progress of the sewing that is indicated by the history data. In a case where the data that are read as the history data are the data that specify the color information for the embroidery thread for which the sewing has been completed and its use order, the sewing of a portion of the pattern that is sewn with the embroidery thread has been completed. Accordingly, the color information for the next embroidery thread that will be used is read. Then the needle bar 31 to which that embroidery thread is supplied is selected, the embroidery frame 200 is moved based on the coordinates of the needle drop point for the first stitch of that color, and the stitch is formed. In a case where the data that are read as the history data are the data that specify the stitch counts, the needle bar 31 to which the embroidery thread of the specified color is supplied is selected, and the sewing is performed based on the coordinates of the needle drop points for which the sewing has not been completed.

In a case where the positioning data have been read from the frame memory 220, the coordinates of the needle drop point are corrected in accordance with the positioning position and the positioning angle in the data that have been read. In a case where the positioning data were edited at Step S303, the coordinates of the needle drop point are corrected in accordance with the data that were set in the editing. Thereafter, the CPU 101 continues the sewing in the same manner as in the new pattern sewing processing (refer to FIG. 9), and if the command to stop the sewing is issued, the CPU 101 stops the sewing (Step S308). The CPU 101 then stores the history data in the history data storage area 223 of the frame memory 220 (Step S309).

The CPU 101 determines whether the sewing of the stored pattern has been completed (Step S310). If the sewing of the stored pattern has not been completed (NO at Step S310), the CPU 101 terminates the frame-stored pattern sewing processing in a state where the history data that are stored in the frame memory 220 has been updated. The CPU 101 then returns to the main processing that is shown in FIG. 8, and terminates the main processing. If the sewing of the stored pattern has been completed (YES at Step S310), the CPU 101 performs the clear processing (Step S400; FIG. 11), terminates the frame-stored pattern sewing processing, returns to the main processing that is shown in FIG. 8, and terminates the main processing. The clear processing that is performed in the frame-stored pattern sewing processing is identical to the clear processing that is performed in the new pattern sewing processing (refer to FIG. 9), so an explanation of it will be omitted.

In the main processing that is shown in FIG. 8, in a case where an item called "clear embroidery frame data" is selected on a menu screen that is displayed on the LCD 7, for example, the CPU 101 determines that a command has been issued to clear the data that are stored in the frame memory 220 (YES at Step S104). In that case, the clear processing is performed (Step S400). The clear processing that is performed in the main processing is also identical to the clear processing that is performed in the new pattern sewing processing (refer to FIG. 9), so an explanation of it will be omitted.

As explained previously, the attaching of the embroidery frame 200 to the holder 24 of the sewing machine 1 causes the connector 212 of the frame storage device 210 to get connected to the holder connector 90, enabling a wired connection between the embroidery frame 200 and the sewing machine 1. Therefore, communication between the embroidery frame 200 and the sewing machine 1 can be performed more reliably than in the known case where a wireless tag is provided in the embroidery frame. For example, in a case where a plurality of wireless tags are present within the communication range, cross talk may occur during wireless communication. On the contrary, if the frame storage device 210 according to the present embodiment is provided in the embroidery frame 200, this sort of concern does not arise. In addition, because there is no need to provide a tag reader in the sewing machine 1 for performing wireless communication with the wireless tag, the cost can be reduced. Moreover, because the communication with the sewing machine 1 is wired communication, it is possible to install the flash memory 220, which has a larger storage capacity than the wireless tag that performs wireless communication. It is therefore possible to store the sewing data that may have a large volume.

The CPU 101 of the sewing machine 1 can access the flash memory (the frame memory) 220 of the frame storage device 210 that is connected through the holder connector 90. Accordingly, in the sewing machine 1, the internally stored pattern that is selected by the user can be stored in the frame memory 220. Furthermore, in a case where the user has set the positioning position and the positioning angle for the embroidery pattern, the sewing machine 1 can store in the frame memory 220 the positioning data that indicate the positioning position and the positioning angle. In a case where the sewing is terminated (interrupted) before the embroidery pattern is completed, the sewing machine 1 can also store in the frame memory 220 the history data that indicate the state of progress of the sewing.

The sewing machine 1 is able to read the sewing data and the like that are stored in the frame memory 220 and perform the sewing using the data. Using the sewing data that are stored in the frame memory 220 makes it possible to sew the same embroidery pattern any number of times, for example. In that case, once the embroidery frame 200 has been set in the sewing machine 1, the user does not have to specify the embroidery pattern that will be sewn. In a case where the user has changed the positioning position and the positioning angle as desired from the initial values for the positioning position and the positioning angle, using the positioning data that are stored in the frame memory 220 makes it possible, the next time that the sewing is performed, to perform the sewing at the same positioning position and the same positioning angle without resetting the positioning data.

Furthermore, using the history data that are stored in the frame memory 220 makes it possible, for a pattern for which the sewing was interrupted before it was completed, to restart the sewing from the point where it was interrupted. For example, the sewing machine 1 can interrupt the sewing of an embroidery pattern, perform sewing of a different pattern, then restart the sewing of the first pattern from the point where it was interrupted. It is also possible, for example, for a single embroidery frame to be shared among a plurality of sewing machines, with each of the sewing machines sewing only a portion of the pattern that can be sewn using the embroidery threads that are mounted in that sewing machine, and with the rest of the work being passed along to another sewing machine. Hereinafter, an example of the use of the embroidery frame 200 and the sewing machine 1 in a case where the user has selected, as the pattern that is to be sewn, an embroidery pattern in which fifteen colors of thread are used will be explained, as a specific example of a case where a single embroidery frame is shared among a plurality of sewing machines.

As described previously, the sewing machine 1 that is shown in FIG. 3 can use six different colors of embroidery thread, because a maximum of six of the thread spools 13 can be mounted. In other words, if the number of colors that will be used in the embroidery pattern is not greater than six, the embroidery pattern can be completed without replacing any of the threads. On the other hand, in a case where fifteen colors of embroidery thread will be used, as in the present example, the threads would have to be replaced. Replacing the threads requires that the thread spools 13 be replaced and that the new threads be threaded through to the needles 35. Therefore, for the user, it may be bothersome work that requires considerable effort. In the present example, the history data that are stored in the frame memory 220 of the embroidery frame 200 can be utilized such that the single embroidery pattern is completed by three users using the same embroidery frame 200 on three sewing machines 1. This can improve the efficiency of the work until the embroidery pattern is completed, because it is not necessary to replace the threads on any of the sewing machines 1. In the explanation that follows, the three sewing machines 1 are called the sewing machines A, B, and C, respectively. The three users who use the sewing machines A, B, and C are called the users A, B, and C, respectively.

In the present example, first, the user A who uses the first sewing machine A attaches the embroidery frame 200, for which nothing has been stored yet in the frame memory 220, to the holder 24. Then the main processing that is shown in FIG. 8 is started, and the new pattern sewing processing (refer to FIG. 9) is performed (Step S200). In the new pattern sewing processing, the user A selects the pattern that is to be sewn (Step S201) and adjusts the positioning position and the positioning angle to the desired position and angle (Step S202).

After the sewing data and the positioning data for the selected pattern have been stored in the frame memory 220 (Step S203), the sewing is performed (Step S205, Step S206). The sewing continues in that manner, and when the sewing has been completed within the range of what can be sewn using the six colors of embroidery thread that are mounted in the sewing machine A, a message that prompts the user to replace the threads is displayed on the LCD 7, and the sewing is stopped (Step S207). The use order data and the color information for the embroidery thread that was the sixth to be used are stored as the history data in the frame memory 220 (Step S208). The embroidery pattern has not been completed (NO at Step S209), so the processing is terminated.

The user A of the sewing machine A removes the embroidery frame 200 from the holder 24 of the sewing machine A and passes it to the user B of the second sewing machine B. After the user B attaches the embroidery frame 200 to the holder 24 of the sewing machine B, the main processing that is shown in FIG. 8 is started in the sewing machine B. In this case, because the sewing data are stored in the frame memory 220 (YES at Step S102), the frame-stored pattern sewing processing (refer to FIG. 10) is performed (Step S300). In the frame-stored pattern sewing processing, the embroidery pattern that the user A of the sewing machine A selected and the positioning data that include the positioning position and the positioning angle that the user A edited are read from the frame memory 220 (Step S301). The history data that were stored by the sewing machine A and that include the use order data and the color information for the embroidery thread that was the sixth to be used are also read (Step S301).

Accordingly, in the sewing machine B, the sewing is performed starting from the first needle drop point that corresponds to the embroidery thread that is the seventh in the use order (Step S306, Step S307). When the sewing has been completed within the range of what can be sewn using the six colors of embroidery thread that are mounted in the sewing machine B, a message that prompts the user to replace the threads is displayed on the LCD 7, and the sewing is stopped (Step S308). The use order data and the color information for the embroidery thread that was the twelfth to be used are stored as the history data in the frame memory 220 (Step S309). The embroidery pattern has not been completed (NO at Step S310), so the processing is terminated.

The user B of the sewing machine B removes the embroidery frame 200 from the holder 24 of the sewing machine B and passes it to the user C of the third sewing machine C. After the user C attaches the embroidery frame 200 to the holder 24 of the sewing machine C, the main processing that is shown in FIG. 8 is started in the sewing machine C. Also in this case, because the sewing data are stored in the frame memory 220 (YES at Step S102), the frame-stored pattern sewing processing (refer to FIG. 10) is performed (Step S300). In the frame-stored pattern sewing processing, the embroidery pattern that the user A of the sewing machine A selected and the positioning data that include the positioning position and the positioning angle that the user A edited are read from the frame memory 220 (Step S301). The history data that were stored by the sewing machine B and that include the use order data and the color information for the embroidery thread that was the twelfth to be used are also read (Step S301).

Accordingly, in the sewing machine C, the sewing is performed starting from the first needle drop point that corresponds to the embroidery thread that is the thirteenth in the use order (Step S306, Step S307). When the stitch is formed at the last needle drop point that corresponds to the fifteenth embroidery thread, the selected pattern is completed. Accordingly, the sewing is stopped (Step S308). After the use order data and the color information for the embroidery thread that was the fifteenth to be used are stored as the history data (Step S309), the clear processing (refer to FIG. 11) is performed (Step S400).

In the clear processing, the data that are specified by the user C of the sewing machine C are deleted. For example, in a case where the user C wants to use the embroidery frame 200 to sew a new pattern, all of the sewing data, the positioning data, and the history data may be cleared (YES at Step S402; Step S402; Step S403). In this ease, the user C can select a desired new pattern in the new pattern sewing processing (FIG. 9), the data for the new pattern can be stored in the embroidery frame 200, and the sewing can be performed.

The user C may also clear only the history data, or only the positioning data (YES at Step S411; Step S412; S421: NO; or NO at Step S411; YES at Step S421; Step S422; Step S423). In a case where only the history data have been cleared, the user C may set a new work cloth in the embroidery frame 200 and can perform the sewing of the same stored pattern in the sewing machine C using the same positioning position and the same positioning angle. In this case, the six colors that can be sewn with the sewing machine C may be sewn, and if the embroidery frame 200 is then passed to the sewing machine A and the sewing machine B in the same manner as described above, the same stored pattern may be sewn efficiently any number of times on the three sewing machines A to C. In a case where only the positioning data have been cleared, the user C may readjust the positioning position and the positioning angle according to the state of the sewing machine C, for example, then perform the sewing of the same uncompleted embroidery pattern on the sewing machine C after the sewing machine B. Furthermore, if the clear processing is performed again in the main processing, it is possible to clear both the history data and the positioning data. In that case, only the sewing data remain in the frame memory 220, so the positioning position and the positioning angle for the same embroidery pattern can be readjusted, and the sewing can be performed from the start.

In the example that is described above, the single embroidery pattern can easily be sewn on the sewing machines A, B, and C without requiring the sewing machines A, B, and C to be connected by a direct cable or to be connected by a network. Accordingly, the cost that is incurred in the case of a system that connects a plurality of sewing machines can be reduced. In particular, in a case where the positioning position and the positioning angle are edited, the positioning data can be shared, so it is not necessary for the user to edit the positioning position and the positioning angle on the second and subsequent sewing machines. In other words, the burden for the users of the various sewing machines can be significantly reduced. It is also possible to prevent the positional discrepancies that may occur in a case where the positioning position and the positioning angle are edited on the individual sewing machines.

An example has been explained above in which the embroidery frame 200 is attached to the sewing machine 1 and an internally stored pattern in the sewing machine 1 is stored in the frame memory 220. The embroidery frame 200, however, may also be connected to an external device other than the sewing machine 1 as long as the embroidery frame 200 can be connected through the connector 212. Hereinafter, an example of this sort will be explained with reference to FIGS. 12 and 13.

Figure 12:
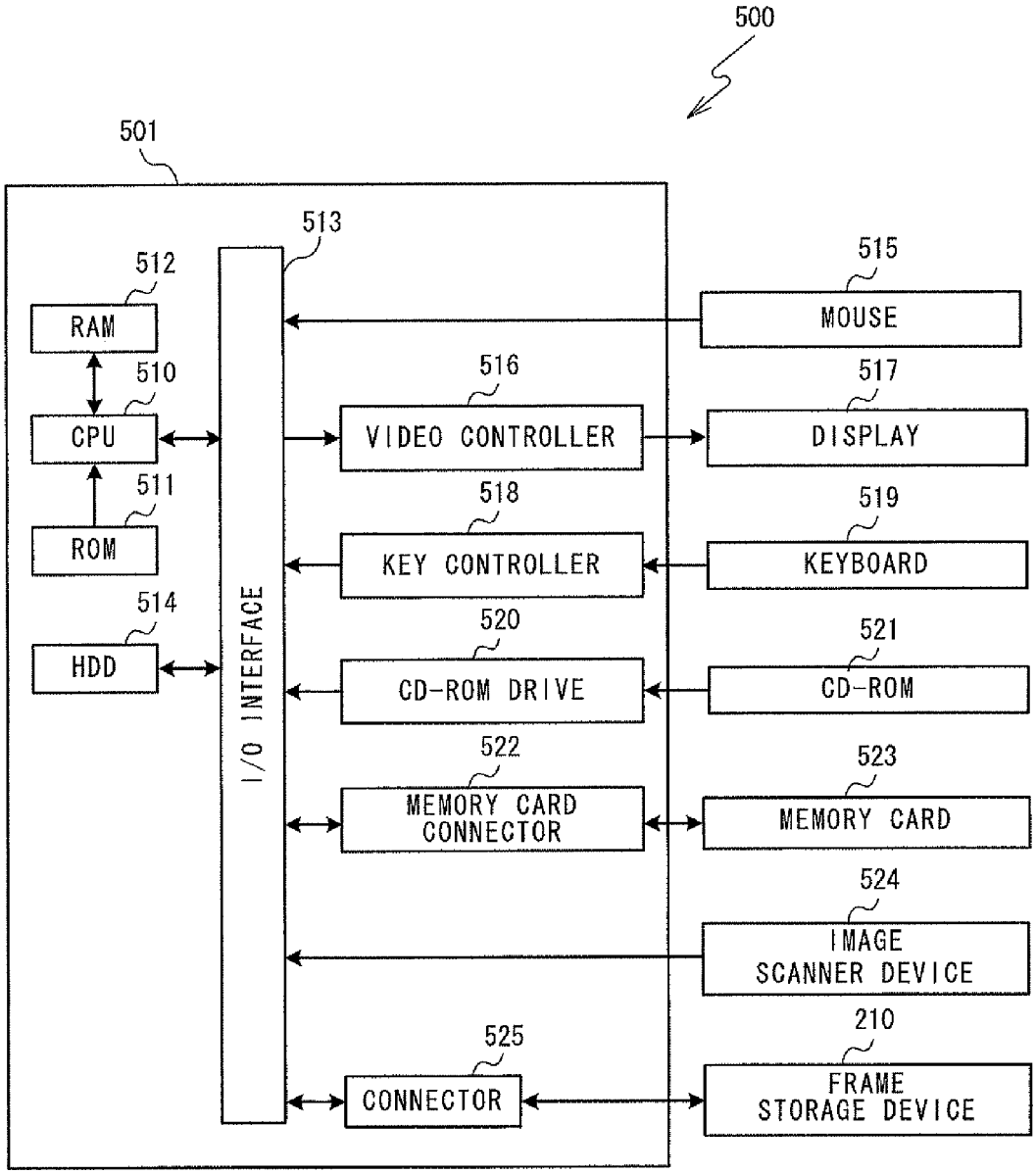
FIG. 12 is a block diagram that shows an electrical configuration of an embroidery data processing device.

The embroidery data processing device 500, which is an example of an external device that can be connected to the frame storage device 210 of the embroidery frame 200 and can access the frame memory 220, will be explained with reference to FIG. 12. The embroidery data processing device 500 is a device that is adapted to create and edit the sewing data that are used by a sewing machine that is capable of performing embroidery sewing, such as the sewing machine 1 or the like. As shown in FIG. 12, the embroidery data processing device 500 may be a general-purpose personal computer, for example, and may include a device body 501, as well as a mouse 515, a display 517, a keyboard 519, an image scanner device 524, and the like that are connected to the device body 501.

The embroidery data processing device 500 is provided with a CPU 510 that performs control of the embroidery data processing device 500. A ROM 511 that stores a BIOS and the like, a RAM 512 that stores various types of data temporarily, and an input/output (I/O) interface 513 that performs mediation of data transfers are connected to the CPU 510. A hard disk drive (HDD) 514, which is a storage device, the mouse 515, which is an input device, a video controller 516, a key controller 518, a CD-ROM drive 520, a memory card connector 522, the image scanner device 524, and a connector 525 are connected to the I/O interface 513.

Various types of information, such as an embroidery data processing program and the like that are executed by the CPU 510 are stored in the HDD 514. Note that in a case where the embroidery data processing device 500 is a dedicated device that is not provided with the HDD 514, an embroidery data creation program may be stored in the ROM 511.

The display 517, which displays information, is connected to the video controller 516. The keyboard 519, which is an input device, is connected to the key controller 518. A CD-ROM 521 can be inserted into the CD-ROM drive 520. For example, when the embroidery data processing program is loaded, the CD-ROM 521 in which the embroidery data processing program is stored is inserted into the CD-ROM drive 520. Then the embroidery data processing program is set up and is stored in a program storage area of the HDD 514 (not shown in the drawings).

A memory card 523 can be connected to the memory card connector 522, and information can be read from and written to the memory card 523. The image scanner device 524 is a general-purpose image reading device. The frame storage device 210 of the embroidery frame 200 (refer to FIG. 1) can be connected to the connector 525, making it possible for the information that is stored in the frame memory 220 to be read and for information to be written in the frame memory 220 (refer to FIG. 2). Note that in a case where the frame storage device 210 is configured from a USB memory, the connector 525 may be a USB connector.

Figure 13:
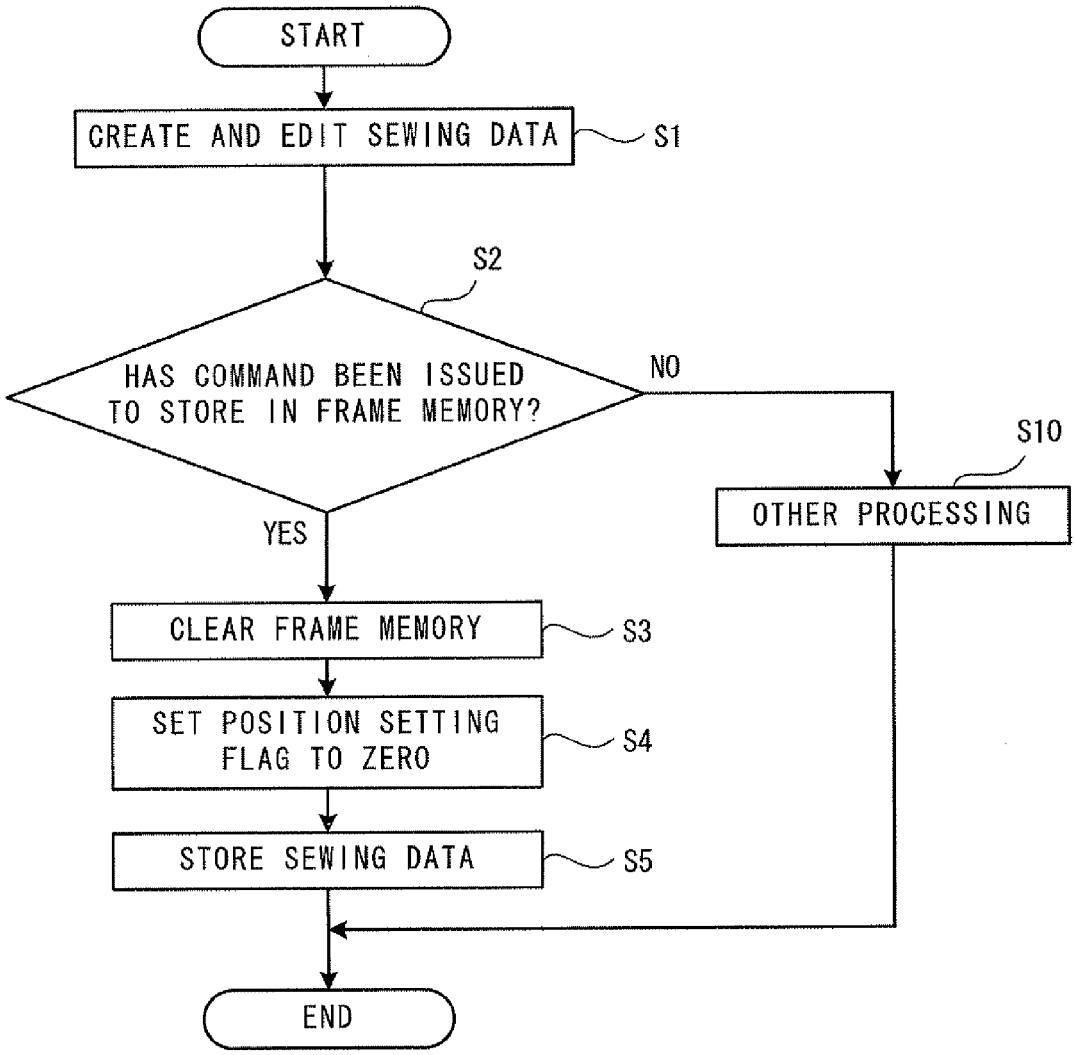
FIG. 13 is a flowchart of main processing in the embroidery data processing device.

Hereinafter, main processing that is performed by the embroidery data processing device 500 will be explained with reference to FIG. 13. The main processing that is shown in FIG. 13 is performed by the CPU 510 in accordance with the embroidery data processing program that is stored in the HDD 514. In the main processing, first, the sewing data that will be used for the embroidery sewing are created and edited as desired (Step S1). As explained earlier, the sewing data are the information that is required of the sewing machine for performing embroidery sewing. The sewing data include information that specifies needle drop points for forming stitches of the embroidery pattern and information that specifies a stitch color, that is, an embroidery thread color. Any known method may be used for creating the sewing data. For example, the sewing data may be created by a known method that creates the sewing data for the embroidery pattern based on image data, of a design, a photograph, or the like, that are read by the image scanner device 524. For example, the method can be used that is described in Japanese Laid-Open Patent Publication No. 2001-259268, the relevant portion of which is herein incorporated by reference.

The user of the embroidery data processing device 500 may also edit the sewing data that are created by the method described above. In that case, the result of sewing based on the created sewing data (the embroidery pattern), for example, as well as editing keys, are displayed on the display 517, and the user performs the editing by operating the mouse 515 and the keyboard 519. The editing may modify the positioning position and the positioning angle, for example, in the same manner as in the example that was described earlier. Note that the sewing data for a plurality of embroidery patterns may be stored in the HDD 514 in advance, and at Step S1, the user may be allowed to select a desired embroidery pattern and edit the positioning position and the positioning angle. The case where the editing of the positioning position and the positioning angle is performed in the embroidery data processing device 500 is different from the case where the editing is performed in the sewing machine 1, in that the information on the positioning position and the positioning angle after the editing is incorporated into the sewing data. In other words, the sewing data are directly modified in accordance with the editing.

After the sewing data have been created, the CPU 510 determines whether a command has been issued to store the sewing data in the frame memory 220 of the embroidery frame 200 (Step S2). For example, if an item called "write to embroidery frame memory" is selected on a menu screen that is displayed on the display 517, the CPU 510 determines that the command to store the sewing data has been issued. Note that the user can connect the connector 212 of the embroidery frame 200 to the connector 525 of the embroidery data processing device 500, one of in advance and at this time, such that the CPU 510 can access the frame memory 220.

In a case where the command to store the sewing data has been issued (YES at Step S2), the CPU 510 accesses the frame memory 220 and clears all of the data that are stored in the frame memory 220 (Step S3). In the embroidery data processing device 500, as described above, the settings for the positioning position and the positioning angle are incorporated in the sewing data, so there are no positioning data. Accordingly, the CPU 510 sets the position setting flag to zero (0) and stores it in the position setting storage area 224 (Step S4), so that the positioning position and the positioning angle can be edited in the sewing machine 1. The CPU 510 stores the sewing data that were created (or selected) at Step S1 in the sewing data storage area 221 (Step S5) and terminates the processing. In a case where the command to store the sewing data has not been issued (NO at Step S2), other processing (Step S10) is performed in accordance with another command that has been input, and the processing is terminated.

As explained above, the embroidery frame 200 according to the present embodiment can be connected to an external device, other than the sewing machine 1, that, like the embroidery data processing device 500, has a connector that can be joined to the connector 212 of the embroidery frame 200. Accordingly, the creation of the sewing data for the embroidery pattern and the sewing of the embroidery pattern can be performed in different places and by different persons. A specific example of such a case will be explained below.

A person who creates the data (hereinafter called the data creator) sets the work cloth on which the embroidery pattern will be sewn into the embroidery frame 200. The data creator connects the connector 212 of the embroidery frame 200 to the connector 525 of the embroidery data processing device 500. Then, when the main processing is started in the embroidery data processing device 500 (refer to FIG. 13), the data creator operates the embroidery data processing device 500 to create and edit the sewing data for a desired embroidery pattern (Step S1). The created sewing data is stored in the frame memory 220 (Step S5). Thereafter, the embroidery frame 200 in which the work cloth has been set is passed to a person who does the sewing (hereinafter called the sewing operator). When the sewing operator attaches the embroidery frame 200 to the holder 24 of the sewing machine 1, the sewing machine 1 and the frame storage device 210 get connected through the holder connector 90 and the connector 212.

When the main processing in the sewing machine 1 is started (refer to FIG. 8), the frame-stored pattern sewing processing (refer to FIG. 10) is performed (Step S300). In the frame-stored pattern sewing processing, the sewing data that were created and edited by the data creator are read from the frame memory 220 (Step S301), and the sewing is performed (Step S306). Therefore, the sewing operator who operates the sewing machine 1 is able to perform the sewing of the embroidery pattern with the sewing machine 1 simply by attaching the received embroidery frame 200 as is to the holder 24. In this example, the embroidery frame 200 in which the work cloth has been set fulfills the role of a work instruction sheet for the sewing operator. Therefore, it is possible to prevent the sewing operator from making an operating error such as performing the sewing on a different work cloth from the one that is specified by the instructions.

Note that it is obviously possible for the embroidery frame 200 and the sewing machine 1 in the embodiment that is described above to be variously modified. For example, the shape of the embroidery frame 200 is not limited to the example shape that is shown in FIG. 1 and can be changed. In addition, as long as the holder connector 90 in the sewing machine 1 and the connector 212 in the embroidery frame 200 can be connected by the attaching of the embroidery frame 200 to the carriage 20 of the sewing machine 1 such that wired communication is enabled, the shapes of the connectors and the positions of the connectors can be freely modified. The portion of the carriage 20 where the embroidery frame 200 is attached does not necessarily have to be the connecting portions 203 and 204, and the left and right supporting portion 92 and 93. As long as the frame memory 220 can be accessed by the sewing machine 1 when the holder connector 90 is connected to the connector 212 of the embroidery frame 200, the frame memory 220 does not necessarily have to be combined in a single unit with the connector 212 to form the frame storage device 210.

In the embodiment, the multi-needle sewing machine 1 that is provided with the six needle bars is explained as an example, but an ordinary sewing machine with only one needle bar may also be used, as long as the sewing machine is capable of performing embroidery sewing and is provided with an embroidery frame moving device to which the embroidery frame 200 can be attached.

In the embodiment, an example is explained in which the positioning position and the positioning angle for the embroidery pattern are edited and the positioning data are stored in the frame memory 220 and used, but other edit data may also be handled in the same manner as the positioning data. Specifically, in a case where the user, at one of Step S202 in FIG. 9 and Step S303 in FIG. 10, one of instead of and in addition to editing the positioning position and the positioning angle, one of enlarges and reduces the embroidery pattern that is specified by the sewing data, inverts the embroidery pattern one of horizontally and vertically, changes the colors of the embroidery threads, or the like, the information that pertains to such edits may also be stored as the edit data at the corresponding one of the next Steps S203 and 304. Then, when the frame-stored pattern sewing processing that is shown in FIG. 10 is performed, the edit data can be read together with the other data at Step S301, and when the sewing is performed, the sewing data may be modified in accordance with the edit data.

In the present embodiment, in the clear processing (FIG. 11) that is performed after the embroidery pattern has been completed (one of YES at Step S209 and YES at Step S310), the data may be deleted in accordance with a user command. In other words, in some cases, the history data will not be cleared, even if the sewing has already been completed. However, the processing may also be performed such that the history data are always cleared after the embroidery pattern has been completed. The processing may also be performed such that the positioning data are also always cleared after the embroidery pattern has been completed. The processing may also be performed such that both the history data and the positioning data are always cleared. In that case, in the new pattern sewing processing in FIG. 9 and in the frame-stored pattern sewing processing in FIG. 10, the CPU 101, instead of performing the clear processing (Step S400), clears one of both the history data and the positioning data and only one of the history data and the positioning data, then terminates the processing.

Figure 14:
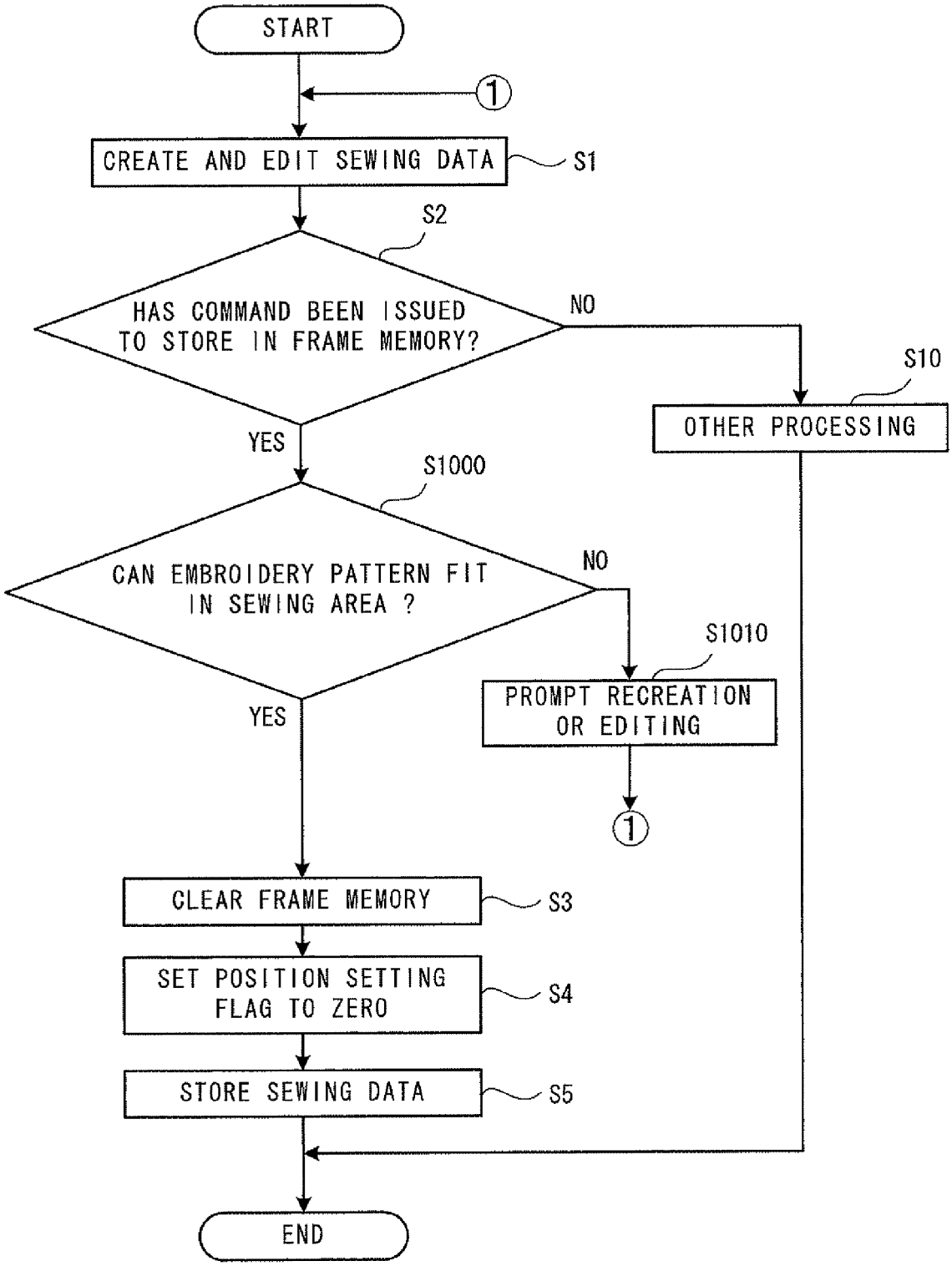
FIG. 14 is a flowchart of main processing that is performed in a multi-needle sewing machine according to a modified example.

In the embodiment, in a case where the sewing data of the embroidery pattern is stored into the frame memory 220 by the embroidery data processing device 500, the relationships between the embroidery pattern and the embroidery frame 200 are not considered. The embroidery data processing device 500, however, may store the sewing data only in a case where the embroidery pattern can be sewn with the embroidery frame 200 that is electrically connected to the embroidery data processing device 500, as shown in FIG. 14. Note that the same step numbers are given to the steps in which the same processing is performed as in FIG. 13.

Specifically, in a case where a command has been issued to store the sewing data in the frame memory 220 (YES at Step S2), the CPU 510 determines whether the embroidery pattern whose sewing data is to be stored will fit within the sewing area 250 that is set in the connected embroidery frame 200, based on the size and the positioning position of the embroidery pattern (S1000). In a case where the CPU 510 determines that the embroidery pattern will fit within the sewing area 250 (YES at Step S1000), the CPU 510 performs storing processing in the same manner as in FIG. 13 (S3; S4; S5). On the other hand, in a case where the CPU 510 determines that the embroidery pattern will not fit within the sewing area 250 (NO at Step S1000), the CPU 510 causes the display 517 to display a message that prompts the user to recreate the embroidery pattern, reduce the size of the embroidery pattern, or move the positioning position of the embroidery pattern closer to the center within the embroidery frame 200, for example. Then the CPU 510 proceeds to the processing of the creating and the editing of the embroidery pattern (Step S1).

Note that the size, the range, the shape and the like of the sewing area 250 that are used in the determination at Step S10000 may be stored beforehand in the embroidery data processing device 500, in association with each of the various types of embroidery frames 200. Information that specifies the connected embroidery frame 200 may be input through a user's operation on the mouse 515 or the keyboard 519. Further, the sewing area 250 of the embroidery frame 200 may be indicated by several types of data that are set beforehand based on the shape and the size of the foot, as well as on the type of the embroidery frame 200.

Similarly, the sewing machine 1 may be configured to store the sewing data of the embroidery pattern only in a case where the embroidery pattern can fit within the sewing area 250 that is set according to the type of the embroidery frame 200. In this case, in the new-pattern sewing processing that is shown in FIG. 9, following the processing at Step S202, the CPU 101 may perform the determination processing that is similar to Step S1000 in FIG. 14. Alternatively, the sewing machine 1 may be provided with a detecting mechanism (a detecting switch, for example) to detect the type of the embroidery frame 200. Then the CPU 101 may store the sewing data and the like in the frame memory 220 at Step S203 only in a case where the CPU 101 has determined that the embroidery pattern can fit within the sewing area 250. In a case where the CPU 101 has determined that the embroidery pattern will not fit within the sewing area 250, the CPU 101 may display the message on the LCD 7 similarly as in the Step S1010 in FIG. 14, and returns to the processing at Step S201.

Figure 15:
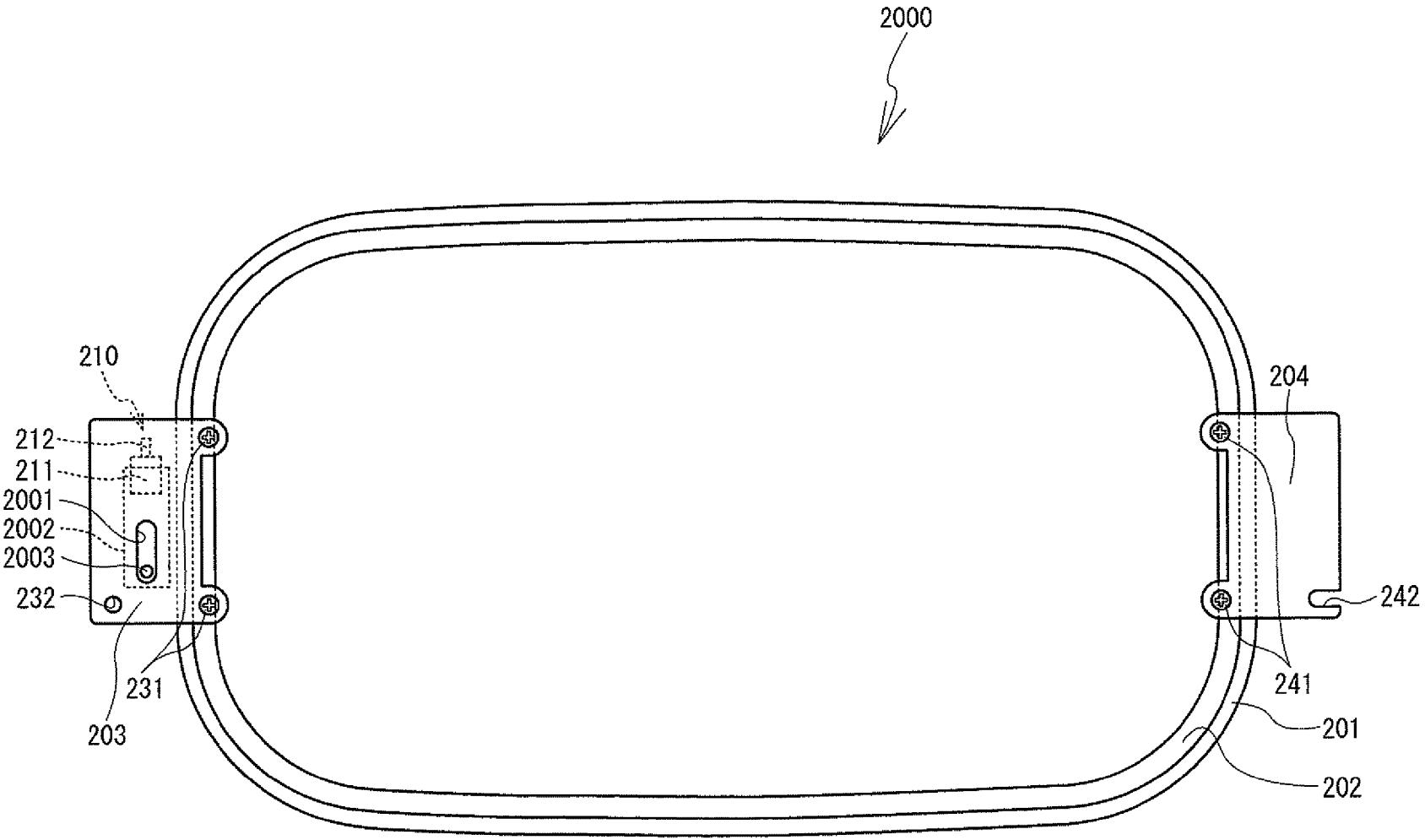
FIG. 15 is a plan view of the carriage to which an embroidery frame according to an modified example is attached.
Figure 16:
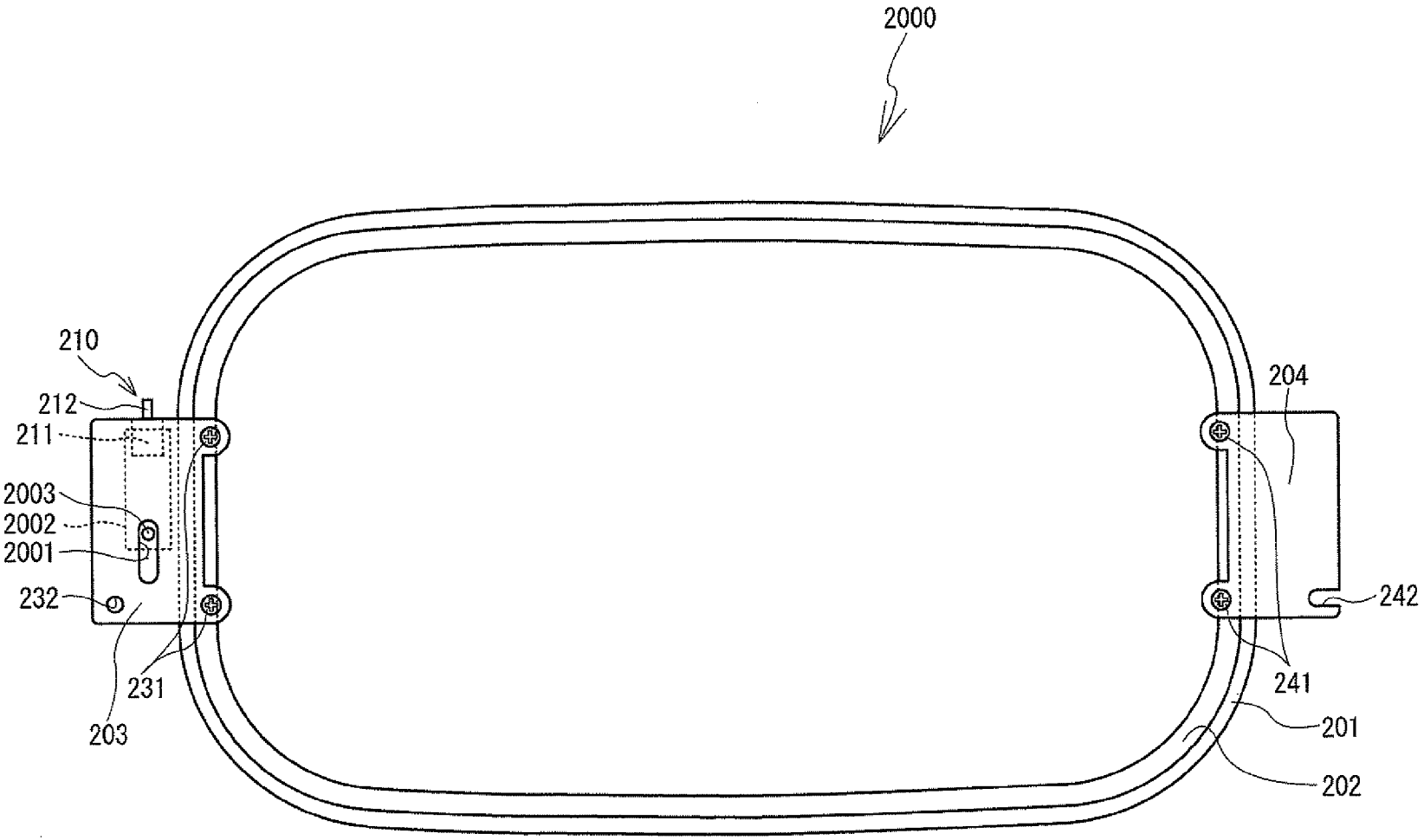
FIG. 16 is another plan view of the carriage to which an embroidery frame according to an modified example is attached.

In the embodiment, at the same time as the embroidery frame 200 that is shown in FIG. 1 is attached to the carriage 20 of the sewing machine 1, the holder connector 90 on the sewing machine 1 side and the connector 212 on the embroidery frame 200 side get connected with each other to enable wired communication. Instead, the embroidery frame may be configured to have the connector 212 that is movable, such that the holder connector 90 on the sewing machine 1 side and the connector 212 on the embroidery frame 200 side can be connected with each other to enable wired communication after the embroidery frame is attached to the carriage 20. FIGS. 15 and 16 show an embroidery frame 2000 of such an example. Note that the same numerals are given to the same members of the embroidery frame 200 that is shown in FIG. 1.

The left connecting portion 203 is provided with an elongated hole 2001 that extends in the front-rear direction of the embroidery frame 2000 (in the left-right direction in FIG. 15). On the lower face side of the left connecting portion 203, a plate 2002 is disposed. The plate 2002 can slide forward and backward along two guide rails (not shown in the drawings) that are provided on the lower face of the left connecting portion 203. The frame storage device 210 is fixed on the lower face of the plate 2002. A lever 2003 is fixed on the upper face of the plate 2002 at a location that is separated to the front side from the connector 212 of the frame storage device 210. The upper end portion of the lever 2003 projects upward through the elongated hole 2001. The user can move the lever 2003 in the front-rear direction of the embroidery frame 2000 along the elongated hole 2001, to thereby change the positions of the plate 2002 and the connector 212 in the front-rear direction in relation to the left connecting portion 203. As shown in FIG. 15, the user can change the position of the connector 212 so that the connector 212 does not project from the rear edge of the left connecting portion 203. Thus, the connector 212 can be prevented from being damaged while the embroidery frame 2000 is separated from the sewing machine 1.

There are at least two methods of attaching the embroidery frame 2000 to the sewing machine 1. The first method is as follows. First, the embroidery frame 2000 is attached to the carriage 20 of the sewing machine 1, in a state where the connector 212 does not project from the left connecting portion 203 as shown in FIG. 15. Then, the lever 2003 is moved by the user from the position that is shown in FIG. 15 toward the rear side (in the left direction in FIG. 16) to the position that is shown in FIG. 16. Thus, the plate 2002 and the connector 212 are moved toward the rear side of the embroidery frame 2000. As a result, the holder connector 90 of the sewing machine 1 and the connector 212 of the embroidery frame 2000 get connected to each other to enable wired communication, and enter the same state as shown in FIG. 5. Thereafter, as the lever 2003 is moved by the user toward the front side (in the right direction in FIG. 16) of the embroidery frame 2000, the plate 2002 and the connector 212 are also moved to the front side. As a result, the holder connector 90 of the sewing machine 1 and the connector 212 of the embroidery frame 2000 are separated from each other to disable wired communication therebetween.

The second method is as follows. The lever 2003 is moved by the user before the embroidery frame 2000 is attached to the carriage 20 of the sewing machine 1 such that the connector 212 projects from the rear edge of the left connecting portion 203. As a result, at the same time as the embroidery frame 2000 is attached to the carriage 20, the holder connector 90 on the sewing machine 1 side and the connector 212 on the embroidery frame 200 side get connected with each other to enable wired communication, and enter the same state as shown in FIG. 5.

The embroidery frame 2000 that is shown in FIGS. 15 and 16 may be modified as follows. Even if the lever 2003 is moved to each of the positions that are shown in FIGS. 15 and 16, the upper end portion of the lever 2003 and any portion of the carriage 20 do not interfere with each other when the embroidery frame 2000 is attached to the carriage 20. Thus, the connector 212 can be moved only with the user's operation on the lever 2003. Instead of this configuration, the embroidery frame may be provided with a member that moves the plate 2002 and the connector 212 to the rear side of the embroidery frame by being pressed by a member of the carriage 20 (the flat spring 97, for example) when the embroidery frame is attached to the carriage 20. In this case, at the same time as the embroidery frame is attached to the carriage 20, the holder connector 90 on the sewing machine 1 side and the connector 212 on the embroidery frame 200 side can get connected with each other to enable wired communication, without a user's operation.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame, comprising:

an attachment portion that can be removably attached to an embroidery frame moving device of a sewing machine that is capable of performing embroidery sewing;

a frame-side connector that is adapted to be connected to a sewing machine-side connector of the sewing machine to enable wired communication between the embroidery frame and the sewing machine, by an attaching of the attachment portion to the embroidery frame moving device; and a storage device that is adapted to store data and can be accessed from the sewing machine in a case where the frame-side connector is connected to the sewing machine-side connector.

2. The embroidery frame according to claim 1, wherein the storage device is adapted to store sewing data, the sewing data being data to be used in the embroidery sewing and that specify a color and needle drop points for an embroidery pattern to be sewn.

3. The embroidery frame according to claim 2, wherein the storage device is adapted to store history data, the history data being data that indicate a state of progress of the embroidery sewing that has been performed based on the sewing data.

4. The embroidery frame according to claim 2, wherein the storage device is adapted to store positioning data, the positioning data being data that specify a positioning position and a positioning angle for the embroidery pattern in relation to a reference position within the embroidery frame.

5. The embroidery frame according to claim 1, wherein the frame-side connector is disposed at a position at which the frame-side connector gets connected to the sewing machine-side connector at the same time as the attachment portion is attached to the embroidery frame moving device.

6. The embroidery frame according to claim 1, further comprising an operation member that is adapted to move the frame-side connector, wherein the frame-side connector, by moving of the operation member, can be moved to a position at which the frame-side connector is connected to the sewing machine-side connector, and to a position at which the frame-side connector is not connected to the sewing machine-side connector.

7. The embroidery frame according to claim 2, wherein the storage device is adapted to store the sewing data for the embroidery pattern that can fit within a sewing area that is set in accordance with the embroidery frame.

8. A sewing machine that is capable of embroidery sewing, comprising:

a sewing device that is adapted to perform embroidery sewing on a work cloth that is provided for the embroidery sewing;

an embroidery frame moving device that is adapted to move an embroidery frame that holds the work cloth;

a frame support portion that is provided in the embroidery frame moving device and that is adapted to support the embroidery frame by being engaged with an attachment portion of the embroidery frame;

a sewing machine-side connector that is adapted to be connected to a frame-side connector of the embroidery frame to enable wired communication between the embroidery frame and the sewing machine, by an engaging of the attachment portion of the embroidery frame with the frame support portion;

an information acquisition portion that, in a case where the sewing machine-side connector is connected to the frame-side connector, accesses a storage device of the embroidery frame and acquires information that is stored in the storage device, the information including sewing data, the sewing data being data that specify a color and needle drop points for an embroidery pattern to be sewn; and a sewing control portion that controls the sewing device based on the sewing data that are acquired by the information acquisition portion.

9. The sewing machine according to claim 8, further comprising a storage control portion that accesses the storage device in the embroidery frame and stores information in the storage device, wherein:

the information that is stored in the storage device includes history data, the history data being data that indicate a state of progress of the embroidery sewing, that has been performed based on the sewing data, the sewing control portion controls the sewing device based on the sewing data and the history data, and the storage control portion, in a case where the embroidery sewing by the sewing device is interrupted before the sewing of the embroidery pattern is completed, updates the history data and stores the history data in the storage device.

10. The sewing machine according to claim 8, wherein the information that is stored in the storage device includes positioning data, the positioning data being data that specify a positioning position and a positioning angle for the embroidery pattern in relation to a reference position within the embroidery frame, and the sewing control portion controls the sewing device based on the sewing data and the positioning data.

11. The sewing machine according to claim 9, further comprising a history data deletion portion that, in a case where the sewing of the embroidery pattern has been completed, accesses the storage device in the embroidery frame and deletes the history data.

12. The sewing machine according to claim 10, further comprising a positioning data deletion portion that, in a case where the sewing of the embroidery pattern has been completed, accesses the storage device in the embroidery frame and deletes the positioning data.

13. The sewing machine according to claim 8, further comprising:

a delete command accepting portion that accepts a delete command, the delete command being a command to delete at least a portion of the information that is stored in the storage device of the embroidery frame; and an information deletion portion that accesses the storage device of the embroidery frame and deletes the at least a portion of the information, in accordance with the delete command that has been accepted by the delete command accepting portion.

14. The sewing machine according to claim 8, further comprising:

a store command accepting portion that accepts a store command, the store command being a command to store new information in the storage device of the embroidery frame; and a storage control portion that accesses the storage device in the embroidery frame and stores the new information in the storage device, in accordance with the store command that has been accepted by the store command accepting portion.

15. The sewing machine according to claim 8, wherein the storage device stores the sewing data for the embroidery pattern that can fit within a sewing area that is set in accordance with the embroidery frame.

16. The sewing machine according to claim 8, wherein:

the information that is stored in the storage device includes positioning data, the positioning data being data that specify a positioning position and a positioning angle for the embroidery pattern that can fit within a sewing area that is set in accordance with the embroidery frame; and the sewing control portion controls the sewing device based on the sewing data and the positioning data.

17. A computer-readable medium storing a control program for a sewing machine that includes a sewing device that is adapted to perform embroidery sewing on a work cloth for embroidery sewing and an embroidery frame moving device that is adapted to move an embroidery frame for holding the work cloth, the program comprising instructions that cause a controller of the sewing machine to perform the steps of:

acquiring, by accessing a storage device of the embroidery frame, in a case where a sewing machine-side connector of the sewing machine is connected to a frame-side connector of the embroidery frame, information that is stored in the storage device, the sewing machine-side connector being adapted to be connected to the frame-side connector to enable wired communication between the sewing machine and the embroidery frame, by an engaging of a frame support portion of the sewing machine with an attachment portion of the embroidery frame, the frame support portion being provided in the embroidery frame moving device and being adapted to support the embroidery frame by being engaged with the attachment portion, the information that is stored in the storage device including sewing data that specify a color and needle drop points for an embroidery pattern to sewn; and controlling the sewing device based on the acquired sewing data.

* * * * *